US011384767B2

(12) United States Patent
Zhang et al.

(10) Patent No.: US 11,384,767 B2
(45) Date of Patent: Jul. 12, 2022

(54) BLOWER APPARATUS

(71) Applicant: Nidec Corporation, Kyoto (JP)

(72) Inventors: Guiling Zhang, Kyoto (JP); Hidenobu Takeshita, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 16/574,201

(22) Filed: Sep. 18, 2019

(65) Prior Publication Data

US 2020/0095999 A1 Mar. 26, 2020

(30) Foreign Application Priority Data

Sep. 25, 2018 (JP) ..... JP2018-178990

(51) Int. Cl.

| | |
|---|---|
| ***F04D 19/00*** | (2006.01) |
| ***F04D 25/06*** | (2006.01) |
| ***F04D 25/08*** | (2006.01) |
| ***F04D 29/52*** | (2006.01) |
| ***F04D 19/02*** | (2006.01) |

(52) U.S. Cl.

CPC ..... *F04D 19/007* (2013.01); *F04D 19/024* (2013.01); *F04D 25/0606* (2013.01); *F04D 25/08* (2013.01); *F04D 29/522* (2013.01)

(58) Field of Classification Search

CPC .. F04D 19/007; F04D 19/024; F04D 25/0606; F04D 25/0613; F04D 29/08; F04D 29/522

See application file for complete search history.

(56) References Cited

U.S. PATENT DOCUMENTS 6,121,710 A * 9/2000 Ho ..... H02K 1/187 310/216.074
8,226,350 B2 * 7/2012 Hayashigaito ..... F04D 29/526 415/66
8,297,914 B2 * 10/2012 Chang ..... F04D 19/007 415/66
8,322,998 B2 * 12/2012 Hanaoka ..... F04D 19/007 417/244

(Continued)

FOREIGN PATENT DOCUMENTS

| | | |
|---|---|---|
| CN | 104895816 A | 9/2015 |
| CN | 105257596 A | 1/2016 |
| JP | 3071456 U | 9/2000 |

OTHER PUBLICATIONS

Official Communication issued in corresponding Chinese Patent Application No. 201910884744.7 dated Jul. 16, 2020.

*Primary Examiner* — Christopher R Legendre
(74) *Attorney, Agent, or Firm* — Keating & Bennett

(57) ABSTRACT

A blower apparatus includes a casing, ribs located radially inward of the casing and integrally provided with the casing, a motor housing located radially inward of the ribs and integrally provided with the ribs, a first housing located radially inward of the motor housing, a first motor supported on one side in an axial direction by the first housing, a first impeller rotatable around the central axis on one side in the axial direction by the first motor, a second housing located on the other side of the first housing in the axial direction, a second motor supported on the other side in the axial direction by the second housing, and a second impeller rotatable around the central axis on the other side in the axial direction by the second motor. The second housing is fixed to the first housing.

7 Claims, 16 Drawing Sheets

(56) References Cited

U.S. PATENT DOCUMENTS

| | | | | |
|---|---|---|---|---|
| 2003/0133791 | A1 | 7/2003 | Huang et al. | |
| 2008/0138191 | A1 | 6/2008 | Chang et al. | |
| 2010/0033041 | A1 | 2/2010 | Watanabe et al. | |
| 2012/0032542 | A1* | 2/2012 | Liu | H02K 5/10 310/88 |
| 2020/0095999 | A1* | 3/2020 | Zhang | F01D 1/02 |
| 2020/0096000 | A1* | 3/2020 | Zhang | F04D 19/007 |

* cited by examiner

BLOWER APPARATUS

CROSS REFERENCE TO RELATED APPLICATION

The present invention claims priority under 35 U.S.C. § 119 to Japanese Application No. 2018-178990 filed on Sep. 25, 2018, the entire contents of which are hereby incorporated herein by reference.

1. FIELD OF THE INVENTION

The present disclosure relates to a blower apparatus including two impellers arranged in the axial direction.

2. BACKGROUND

Conventionally, a known blower apparatus is constructed by connecting a first casing and a second casing. The first casing houses a first impeller and a first motor. The second casing houses a second impeller and a second motor. When the first casing and the second casing are connected, the first impeller and the second impeller are axially aligned such that central axes serving as rotation centers are coaxial.

An intake port is provided on one side (for example, the upper side) in the axial direction of the first casing. A plurality of first ribs arranged in the circumferential direction are provided on the other side (for example, the lower side) of the first casing in the axial direction. First openings are formed between the circumferentially adjacent first ribs. A first support frame is provided radially inward of the plurality of first ribs. The first support frame supports the first motor.

A plurality of second ribs arranged in the circumferential direction are provided on one side (for example, the upper side) of the second casing in the axial direction. A discharge port is provided on the other side (for example, the lower side) of the second casing in the axial direction. Second openings are formed between the circumferentially adjacent second ribs. A second support frame is provided radially inward of the plurality of second ribs. The second support frame supports the second motor.

When the first impeller and the second impeller are respectively rotated by the first motor and the second motor, air is sucked into the interior of the first casing through the intake port. The sucked air flows toward the discharge port sequentially through the first openings and the second openings, and is discharged to the outside through the discharge port.

The rotation direction of the second impeller is opposite to the rotation direction of the first impeller. The orientations of blades of the first impeller and the second impeller are set such that, when the first impeller and the second impeller are rotated, the air flows from the intake port to the discharge port in the first casing and the second casing.

In the configuration described above, it is necessary to ensure a minimum necessary length (thickness) of the first ribs of the first casing and the second ribs of the second casing in the axial direction, from the viewpoint of preventing damage due to impact and ensuring reliability. For this reason, when the first casing and the second casing are connected in the axial direction, the axial length of the overall casing is increased, which may make it difficult to reduce the thickness of the blower apparatus.

In addition, if distortion occurs due to a manufacturing error on the bonding surfaces of the first casing and the second casing, such distortion may cause "rattling" or the like when the first casing and the second casing are combined. The "rattling" causes vibration and noise when the blower apparatus is used. Therefore, it is desirable to provide a blower apparatus that can avoid the occurrence of such vibration and noise.

Furthermore, development of blower apparatuses that are easy to assemble is also required nowadays. It is considered that, in the configuration described above, assembling is facilitated by connecting the first casing and the second casing. However, in the configuration in which the first casing and the second casing are connected, it is difficult to reduce the thickness of the blower apparatus, and vibration and noise are also generated due to distortion of the bonding surface, as described above. Therefore, it is desirable to achieve a blower apparatus that can be reduced in thickness with improved ease of assembly, and that can prevent occurrence of vibration and noise due to distortion of bonding surfaces.

SUMMARY

A blower apparatus according to an example embodiment of the present disclosure includes a casing including an intake port located on an upper side of a central axis that extends vertically, and a discharge port located on a lower side of the central axis, a plurality of ribs located radially inward of the casing and provided integrally with the casing, a motor housing located radially inward of the plurality of ribs and provided integrally with the plurality of ribs, a first housing located radially inward of the motor housing, a first motor supported on one side in an axial direction by the first housing, a first impeller rotatable around the central axis on the one side in the axial direction by the first motor, a second housing located on another side of the first housing in the axial direction, a second motor supported on the another side in the axial direction by the second housing, and a second impeller rotatable around the central axis on the another side in the axial direction by the second motor. The second housing is fixed to the first housing.

The above and other elements, features, steps, characteristics and advantages of the present disclosure will become more apparent from the following detailed description of the example embodiments with reference to the attached drawings.

DETAILED DESCRIPTION

Hereinafter, example embodiments of the present disclosure will be described in detail with reference to the accompanying drawings. It is assumed herein that: an axis serving as a rotation center of a first impeller and a second impeller is referred to as a "central axis"; and the direction in which the central axis extends is referred to by the term "axial direction", "axial", or "axially". In addition, directions perpendicular to the central axis with respect to the central axis are each referred to simply by the term "radial direction", "radial", or "radially". In this regard, in the radial direction, the side closer to the central axis is referred to by the term "radially inner side" or "radially inward", and the side farther from the central axis is referred to by the term "radially outer side" or "radially outward". Further, a direction along a circular arc around the central axis is referred to by the term "circumferential direction", "circumferential", or "circumferentially".

It is also assumed herein that, for the sake of convenience of description, an axial direction is defined as a vertical direction, and the shape of each member or part and relative positions of different members or parts will be described on the assumption that a vertical direction of the blower apparatus corresponds to the vertical direction of the axial direction. In this regard, one of the directions of the axis is referred to by the term "upper" or "top", and the other direction of the axis is referred to by the term "lower" or "bottom". Further, one side in the axial direction is referred to by the term "axially above", "above in the axial direction", or "upper side in the axial direction", and the other side in the axial direction is referred to by the term "axially below", "below in the axial direction" or "lower side in the axial direction". It should be noted, however, that the above definition of the vertical direction is not intended to restrict the orientation of, or relative positions of different members or parts of, the blower apparatus when in use.

It is also assumed herein that a section parallel to the axial direction is referred to as a "longitudinal section". Note that the wording "parallel" as used herein includes not only "exactly parallel" but also "substantially parallel".

Figure 1:
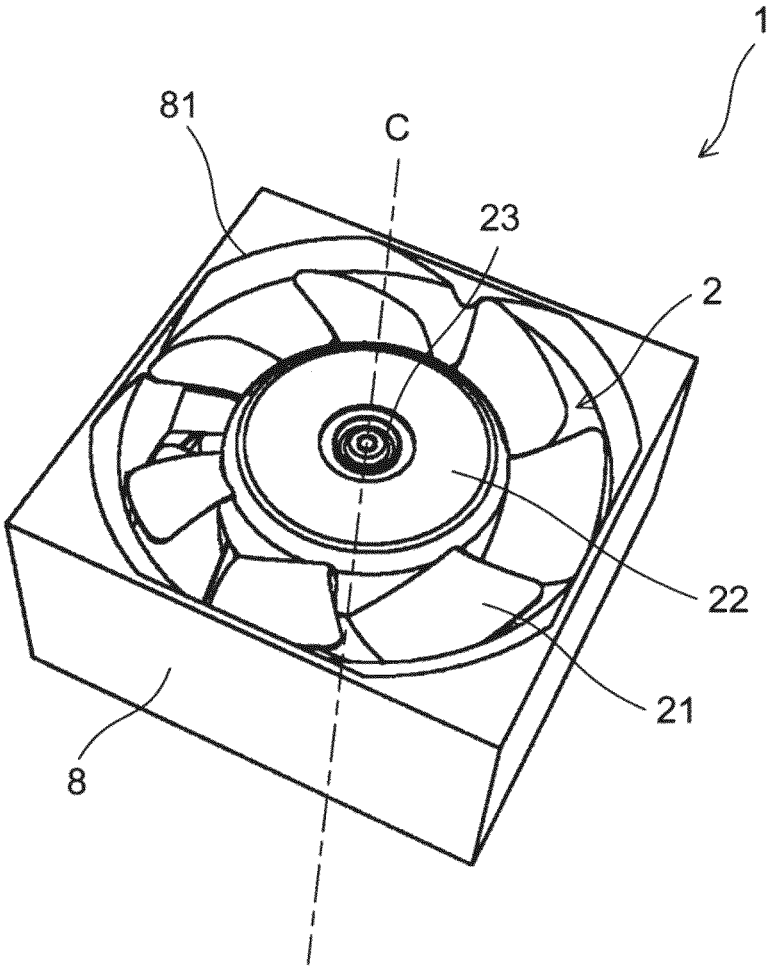
FIG. 1 is a perspective view of a blower apparatus according to an example embodiment of the present disclosure as viewed from an intake port side.
Figure 2:
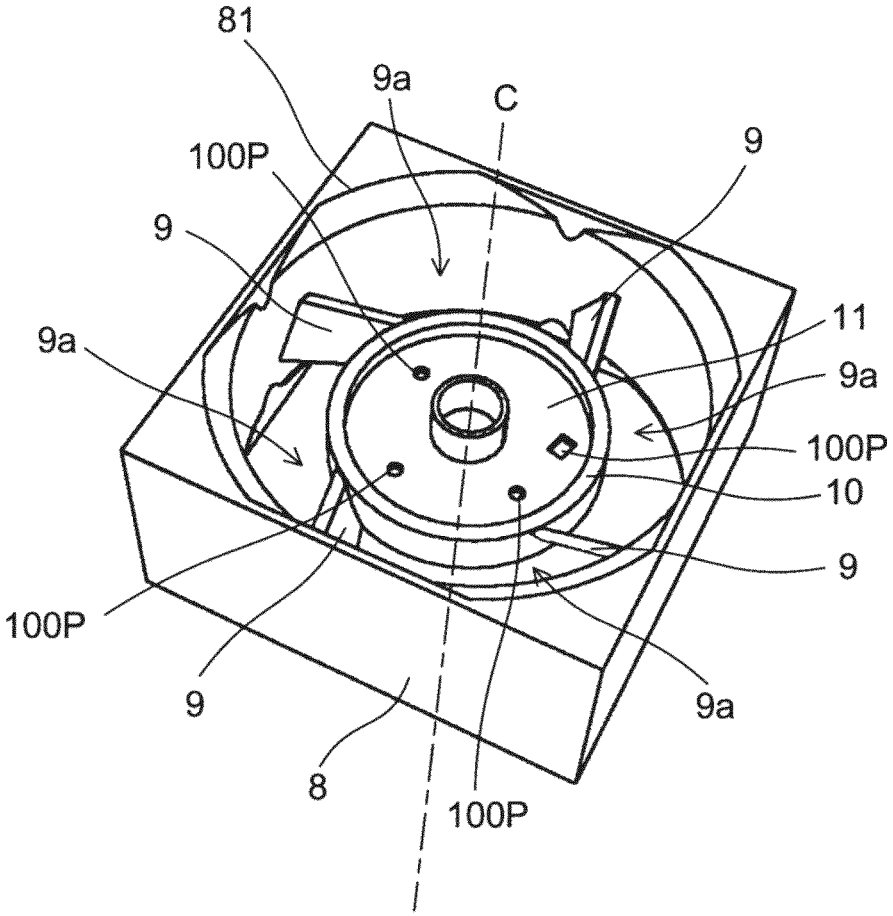
FIG. 2 is a perspective view of a configuration of a part of the inside of a casing of the blower apparatus as viewed from the intake port side.
Figure 3:
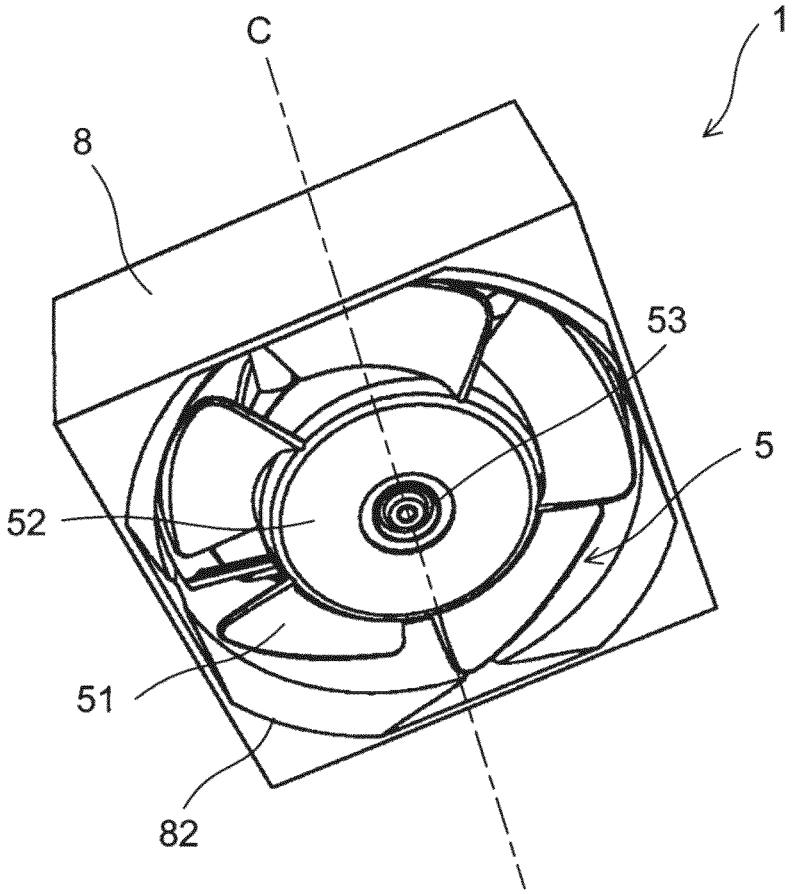
FIG. 3 is a perspective view of the blower apparatus as viewed from a discharge port side.
Figure 4:
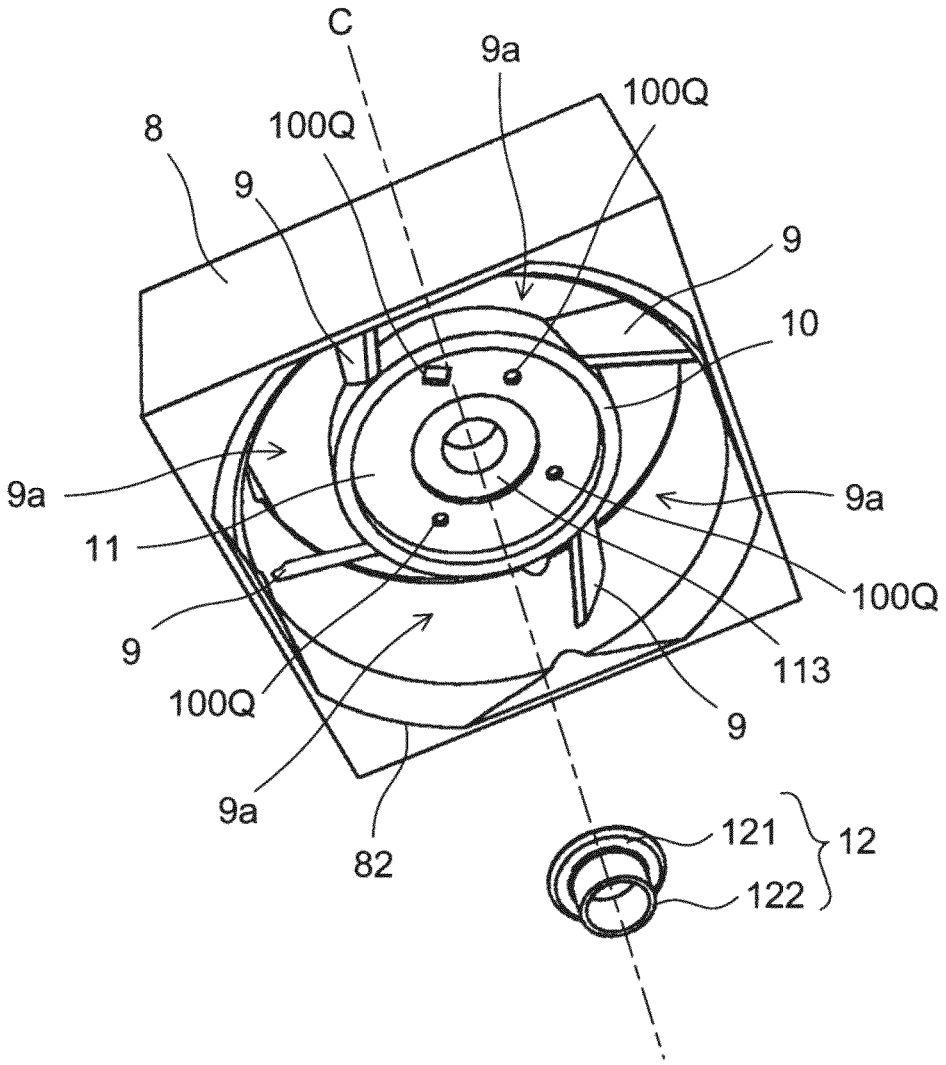
FIG. 4 is a perspective view of a configuration of a portion of the inside of the casing of the blower apparatus as viewed from the discharge port side.
Figure 5:
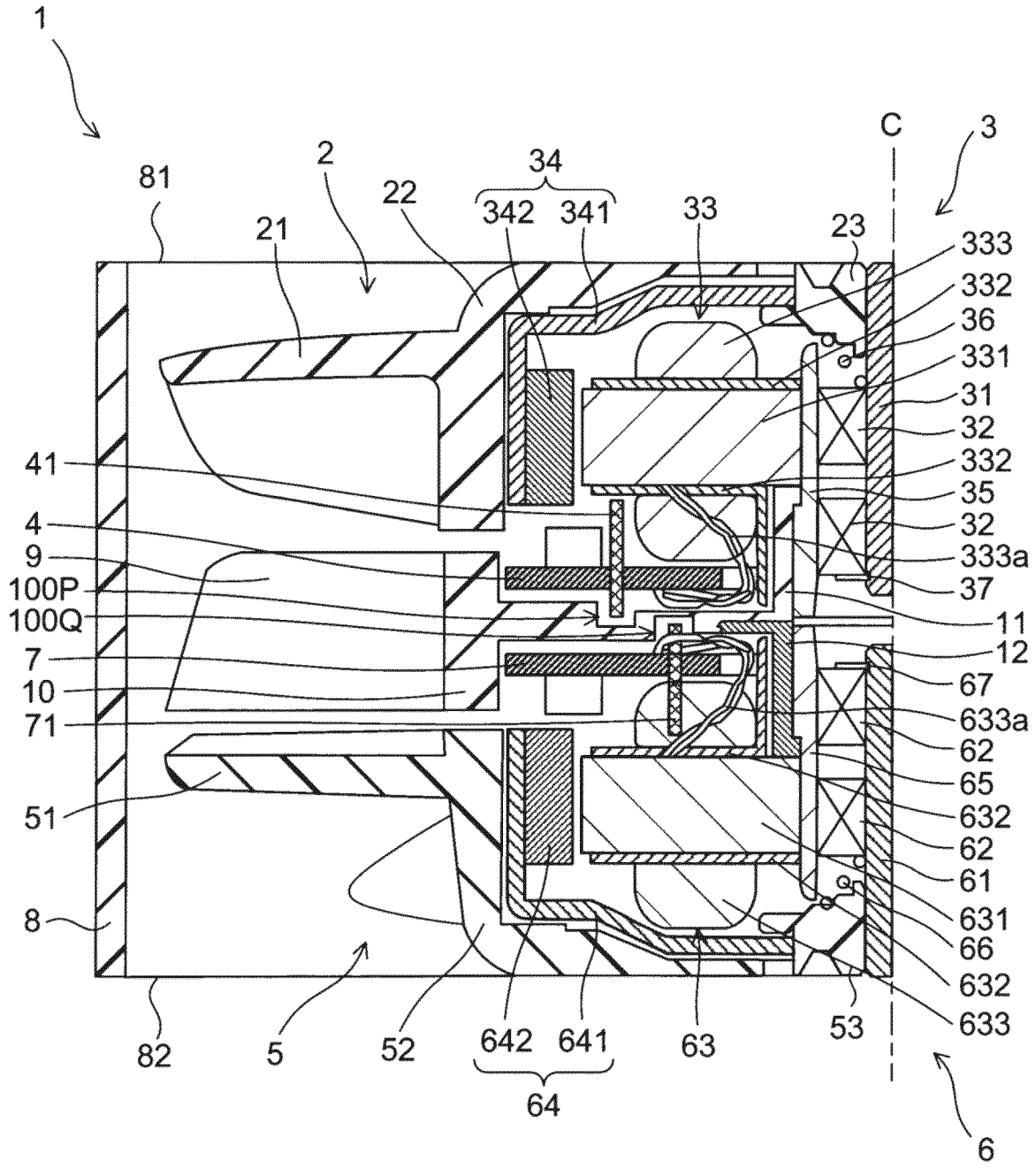
FIG. 5 is a longitudinal sectional view of the blower apparatus.

FIG. 1 is a perspective view of a blower apparatus 1 according to an example embodiment of the present disclosure as viewed from an intake port 81 side. FIG. 2 is a perspective view of the configuration of a part of the inside of a casing 8 of the blower apparatus 1 as viewed from the intake port 81 side. FIG. 3 is a perspective view of the blower apparatus 1 as viewed from a discharge port 82 side. FIG. 4 is a perspective view of the configuration of a part of the inside of the casing 8 of the blower apparatus 1 as viewed from the discharge port 82 side. FIG. 5 is a longitudinal sectional view of the blower apparatus 1. For convenience, FIG. 5 shows the cross section of only one side of the blower apparatus 1 in the radial direction with respect to the central axis C.

The blower apparatus 1 is a counter-rotating blower apparatus. Specifically, the blower apparatus 1 includes a first impeller 2, a first motor 3, a first circuit board 4, a second impeller 5, a second motor 6, a second circuit board 7, the casing 8, a plurality of ribs 9, a motor housing 10, a first housing 11, and a second housing 12. The casing 8, the plurality of ribs 9, the motor housing 10, the first housing 11, and the second housing 12 are formed of, for example, resin.

The first impeller 2 is disposed axially above and radially outward of the first motor 3 in the casing 8. The first impeller 2 is rotated about the central axis C by the first motor 3. That is, the blower apparatus 1 includes the first impeller 2 which rotates around the central axis C on one side in the axial direction by the first motor 3.

The first impeller 2 has a first impeller cup 22, a plurality of first blades 21, and a first fixing unit 23. The first impeller cup 22 is fixed to the first motor 3 via the first fixing unit 23. The first impeller cup 22 is a substantially cylindrical member having a lid on the upper side in the axial direction. A rotor yoke 341 of the first motor 3 is fixed to the inside of the first impeller cup 22.

The plurality of first blades 21 are circumferentially arranged on the outer surface of the first impeller cup 22. In the present example embodiment, the first impeller 2 has seven first blades 21 as shown in FIG. 1, but the number of first blades 21 is not limited to seven. The first fixing unit 23 is a member for fixing the first impeller cup 22 to a first shaft 31 of the first motor 3.

The first motor 3 is supported by the first housing 11 on the upper side in the axial direction in the casing 8. Specifically, the blower apparatus 1 includes the first motor 3 supported on one side in the axial direction by the first housing 11. The first motor 3 has the first shaft 31, a first bearing 32, a first stator 33, a first rotor 34, and a first bearing holding unit 35.

The first shaft 31 is arranged to extend along the central axis C. The first shaft 31 is, for example, a columnar member which is made of metal such as stainless steel, and extends in the axial direction. The first shaft 31 is rotatably supported about the central axis C by the first bearing 32. The first shaft 31 is urged upward in the axial direction by a first spring 36 via the first fixing unit 23 with respect to the uppermost first bearing 32 in the axial direction. Thus, the downward movement of the first shaft 31 in the axial direction is suppressed. In addition, a first C retaining ring 37 is attached near the axially lower end of the first shaft 31. This prevents dislodgement of the first shaft 31 toward the upper side in the axial direction.

The first bearing 32 is held radially inward of the first bearing holding unit 35 which is cylindrical around the central axis C, and rotatably supports the first shaft 31 around the central axis C. The first bearing 32 is, for example, a ball bearing, but may be a sleeve bearing or the like.

The first bearing holding unit 35 is made of metal such as stainless steel or resin. When the first bearing holding unit 35 is made of metal, the first bearing holding unit 35 may be integrally formed with the first housing 11 by, for example, insert molding. On the other hand, when the first bearing holding unit 35 is made of resin, the first bearing holding unit 35 may be integrally formed with the first housing 11 by injection molding. Alternatively, the first bearing holding unit 35 and the first housing 11 may be connected by another method such as press-fitting or adhesion using an adhesive.

The first stator 33 is fixed to the outer circumferential surface of the first bearing holding unit 35. The first stator 33 includes a stator core 331, an insulator 332, and a coil 333.

The stator core 331 is formed by laminating electromagnetic steel plates such as silicon steel plates in the vertical direction. The insulator 332 is made of an insulating resin. The insulator 332 is provided to surround the outer surface of the stator core 331. The coil 333 is composed of a conducting wire wound around the stator core 331 via the insulator 332.

The first rotor 34 is disposed axially above and radially outward of the first stator 33. The first rotor 34 rotates around the central axis C with respect to the first stator 33. The first rotor 34 has the rotor yoke 341 and a magnet 342.

The rotor yoke 341 is a substantially cylindrical member that is made of a magnetic material and has a lid on the upper side in the axial direction. The rotor yoke 341 is fixed to the first shaft 31 via the first fixing unit 23. The magnet 342 has a cylindrical shape and is fixed to the inner circumferential surface of the rotor yoke 341. The magnet 342 is disposed radially outward of the first stator 33.

The first circuit board 4 is disposed on the lower side of the first motor 3 in the axial direction, that is, on the second impeller 5 side, in the casing 8. The first circuit board 4 has a disk shape extending in the radial direction about the central axis C, and is provided to drive the first motor 3. The first circuit board 4 is held by the first motor 3 via the insulator 332.

An electronic circuit for supplying a drive current to the coil 333 is mounted on the first circuit board 4 so as to be electrically connected to a lead wire 333*a* of the coil 333. The electronic circuit includes electronic components such as a capacitor and a resistor. The first circuit board 4 is also mounted with a Hall element for detecting the rotational position of the first rotor 34 and a component such as a binding pin around which the lead wire 333*a* is wound and held as necessary. Hereinafter, various components mounted on the first circuit board 4 will be referred to as mounted components 41.

The second impeller 5 is positioned in the casing 8 so as to be aligned with the first impeller 2 in the axial direction. The second impeller 5 is disposed axially below and radially outward of the second motor 6. The second impeller 5 is rotated about the central axis C by the second motor 6. That is, the blower apparatus 1 includes the second impeller 5 that rotates about the central axis C by the second motor 6 on the other side in the axial direction.

The second impeller 5 has a second impeller cup 52, a plurality of second blades 51, and a second fixing unit 53. The second impeller cup 52 is fixed to the second motor 6 via the second fixing unit 53. The second impeller cup 52 is a substantially cylindrical member having a lid on the lower side in the axial direction. A rotor yoke 641 of the second motor 6 is fixed to the inside of the second impeller cup 52.

The plurality of second blades 51 are circumferentially arranged on the outer surface of the second impeller cup 52. In the present example embodiment, the second impeller 5 has five second blades 51 as shown in FIG. 3, but the number of second blades 51 is not limited to five. The second fixing unit 53 is a member for fixing the second impeller cup 52 to a second shaft 61 of the second motor 6.

The second motor 6 is supported by the second housing 12 on the lower side in the axial direction in the casing 8. Specifically, the blower apparatus 1 includes the second motor 6 supported on the other side in the axial direction by the second housing 12. The second motor 6 has the second shaft 61, a second bearing 62, a second stator 63, a second rotor 64, and a second bearing holding unit 65.

The second shaft 61 is arranged to extend along the central axis C. The second shaft 61 is, for example, a columnar member which is made of metal such as stainless steel, and extends in the axial direction. The second shaft 61 is rotatably supported about the central axis C by the second bearing 62. The second shaft 61 is urged downward in the axial direction by a second spring 66 via the second fixing unit 53 with respect to the lowermost second bearing 62. Thus, the upward movement of the second shaft 61 in the axial direction is suppressed. In addition, a second C retaining ring 67 is attached near the axially upper end of the second shaft 61. This prevents dislodgement of the second shaft 61 toward the lower side in the axial direction.

The second bearing 62 is held radially inward of the second bearing holding unit 65 which is cylindrical around the central axis C, and rotatably supports the second shaft 61 around the central axis C. The second bearing 62 is, for example, a ball bearing, but may be a sleeve bearing or the like.

The second bearing holding unit 65 is made of metal such as stainless steel or resin. When the second bearing holding unit 65 is made of metal, the second bearing holding unit 65 may be integrally formed with the second housing 12 by insert molding. On the other hand, when the second bearing holding unit 65 is made of resin, the second bearing holding unit 65 may be integrally formed with the second housing 12 by injection molding. Alternatively, the second bearing holding unit 65 and the second housing 12 may be connected by another method such as press-fitting or adhesion using an adhesive.

The second stator 63 is fixed to the outer circumferential surface of the second bearing holding unit 65. The second stator 63 includes a stator core 631, an insulator 632, and a coil 633.

The stator core 631 is formed by laminating electromagnetic steel plates such as silicon steel plates in the vertical direction. The insulator 632 is made of an insulating resin. The insulator 632 is provided to surround the outer surface of the stator core 631. The coil 633 is composed of a conducting wire wound around the stator core 631 via the insulator 632.

The second rotor 64 is disposed axially below and radially outward of the second stator 63. The second rotor 64 rotates around the central axis C with respect to the second stator 63. The second rotor 64 has a rotor yoke 641 and a magnet 642.

The rotor yoke 641 is a substantially cylindrical member made of a magnetic material and having a lid on the lower side in the axial direction. The rotor yoke 641 is fixed to the second shaft 61 via the second fixing unit 53. The magnet 642 is cylindrical and fixed to the inner circumferential surface of the rotor yoke 641. The magnet 642 is disposed radially outward of the second stator 63.

The second circuit board 7 is disposed on the upper side of the second motor 6 in the axial direction, that is, on the first impeller 2 side, in the casing 8. The second circuit board 7 has a disk shape extending in the radial direction about the central axis C, and is provided to drive the second motor 6. The second circuit board 7 is held by the second motor 6 via the insulator 632.

An electronic circuit for supplying a drive current to the coil 633 is mounted on the second circuit board 7 so as to be electrically connected to a lead wire 633*a* of the coil 633. The electronic circuit includes electronic components such as a capacitor and a resistor. The second circuit board 7 is also mounted with a Hall element for detecting the rotational position of the second rotor 64 and a component such as a binding pin around which the lead wire 633*a* is wound and held as necessary. Hereinafter, various components mounted on the second circuit board 7 will be referred to as mounted components 71.

The casing 8 has an intake port 81 and a discharge port 82. The intake port 81 is an opening for taking in external air into the casing 8. The intake port 81 is positioned on the upper side of the casing 8 in the axial direction. The discharge port 82 is an opening for discharging the air in the casing 8 to the outside. The discharge port 82 is positioned on the lower side of the casing 8 in the axial direction. That is, the blower apparatus 1 has the casing 8 having the intake port 81 positioned on the upper side of the vertically extending central axis C and the discharge port 82 positioned on the lower side of the central axis C. In the present example embodiment, the casing 8 has a unitary structure, and is not constructed by bonding separate casings.

The plurality of ribs 9 are positioned radially inward of the casing 8. The plurality of ribs 9 are located substantially at the center of the casing 8 in the axial direction. The ribs 9 are arranged in the circumferential direction with opening 9*a* therebetween. The opening 9*a* is a hole through which air flowing from the intake port 81 to the discharge port 82 in the casing 8 passes when the first impeller 2 and the second impeller 5 rotate. Each rib 9 is integrally formed with the casing 8. That is, the blower apparatus 1 has a plurality of ribs 9 which are positioned radially inward of the casing 8 and integrally formed with the casing 8.

The motor housing 10 is located radially inward of the plurality of ribs 9 in the casing 8 and is formed so as to surround the central axis C. The motor housing 10 is supported to the casing 8 by the plurality of ribs 9. In the present example embodiment, the motor housing 10 is integrally formed with the plurality of ribs 9. That is, the blower apparatus 1 has the motor housing 10 located radially inward of the plurality of ribs 9 and integrally formed with the plurality of ribs 9.

The first housing 11 supports the first motor 3 on the upper side in the axial direction in the casing 8. The first housing 11 is located radially inward of the motor housing 10. That is, the blower apparatus 1 has the first housing 11 located radially inward of the motor housing 10. In the present example embodiment, the first housing 11 is integrally formed with the motor housing 10.

The second housing 12 supports the second motor 6 on the lower side in the axial direction in the casing 8. The second housing 12 is located below the first housing 11. That is, the blower apparatus 1 has the second housing located on the other side in the axial direction with respect to the first housing 11. The details of the first housing 11 and the second housing 12 will be described later.

In the above configuration, when a drive current is supplied from the first circuit board 4 to the coil 333 of the first motor 3, a magnetic flux in the radial direction is generated in the stator core 331. A magnetic field generated by the magnetic flux of the stator core 331 and a magnetic field generated by the magnet 342 act to generate torque in the circumferential direction of the first rotor 34. The generated torque causes the first rotor 34 and the first impeller 2 to rotate about the central axis C together with the first shaft 31.

In addition, when the drive current is supplied from the second circuit board 7 to the coil 633 of the second motor 6, a magnetic flux in the radial direction is generated in the stator core 631. A magnetic field generated by the magnetic flux of the stator core 631 and a magnetic field generated by the magnet 642 act to generate torque in the circumferential direction of the second rotor 64. The generated torque causes the second rotor 64 and the second impeller 5 to rotate about the central axis C together with the second shaft 61.

When the first impeller 2 and the second impeller 5 rotate, a stream of air flowing from the intake port 81 toward the discharge port 82 is generated by the plurality of first blades 21 and the plurality of second blades 51. That is, air is taken into the casing 8 through the intake port 81. The air taken into the casing 8 passes through the openings 9*a* between the circumferentially adjacent ribs 9 and flows toward the discharge port 82. The air reaching the discharge port 82 is discharged to the outside through the discharge port 82. Therefore, in the configuration of the present example embodiment, air can be blown in one direction from the intake port 81 to the discharge port 82.

Figure 6:
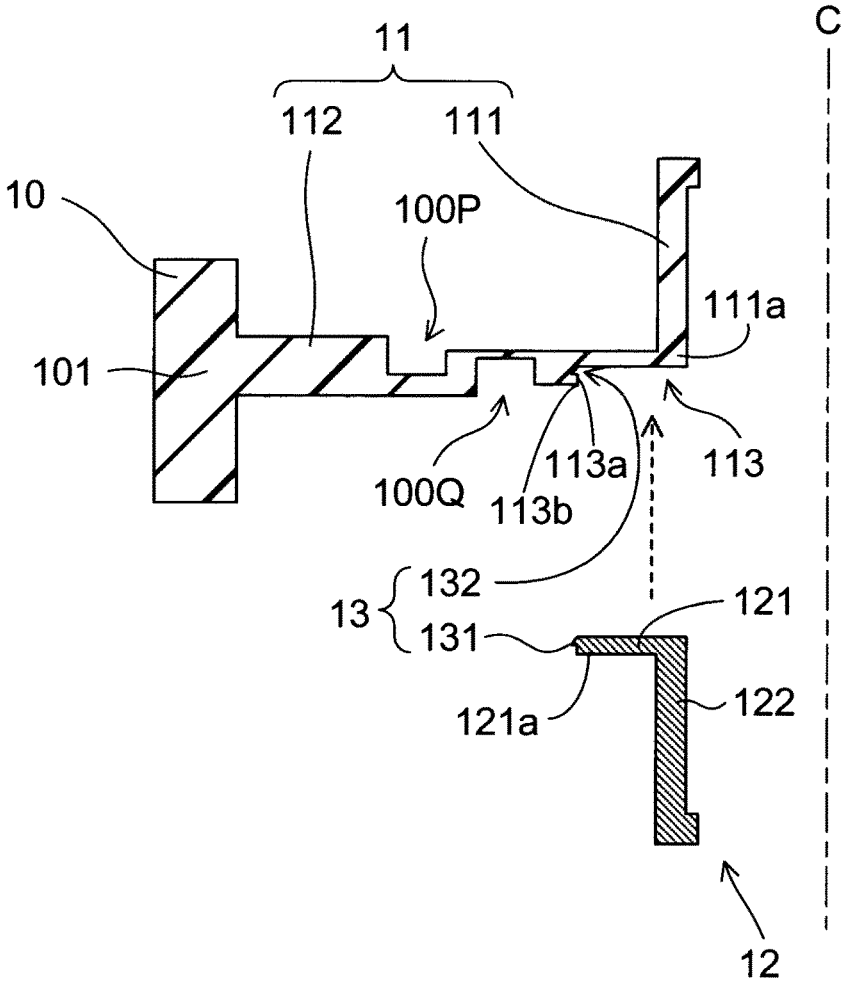
FIG. 6 is an exploded sectional view of a first housing and a second housing of the blower apparatus.

Next, the details of the first housing 11 and the second housing 12 will be described. FIG. 6 is an exploded sectional view of the first housing 11 and the second housing 12.

The first housing 11 has a cylindrical part 111 and a connection part 112. The cylindrical part 111 is formed to surround the central axis C. The inner diameter of the cylindrical part 111 is smaller than the inner diameter of the motor housing 10.

The connection part 112 connects the motor housing 10 and the cylindrical part 111 in the radial direction. More specifically, the connection part 112 radially connects a central part 101 located substantially at the center of the motor housing 10 in the axial direction and an axially lower end 111*a* which is on the lower side of the cylindrical part 111. Thus, the motor housing 10, the cylindrical part 111, and the connection part 112 are integrally formed. That is, the motor housing 10 and the first housing 11 are integrally formed.

The connection part 112 has a holding part 113 on the radially inner side. Here, the holding part 113 is formed as a recess upwardly recessed in the axial direction and having an annular shape as viewed from below in the axial direction, as shown in FIG. 4. The recess of the holding part 113 is formed into a shape conforming to the shape of a flange 121 described later of the second housing 12.

The second housing 12 has the flange 121 and a cylindrical part 122. The flange 121 is a thin plate having an annular shape when viewed from above in the axial direction. The cylindrical part 122 is connected to the flange 121 so as to extend downward in the axial direction.

The second housing 12 is held and fixed to the first housing 11 by inserting the flange 121 of the second housing 12 into the holding part 113 of the first housing 11 from below in the axial direction. That is, in the blower apparatus 1, the second housing 12 is fixed to the first housing 11. The second housing 12 is fixed by a snap-fit 13 so as not to be disengaged from the first housing 11, the detail of which will be described later.

In the present example embodiment, the plurality of ribs 9 are located radially inward of the casing 8 as described above. The motor housing 10 is located radially inward of the plurality of ribs 9. The first housing 11 is located radially inward of the motor housing 10. The first motor 3 is supported on the upper side in the axial direction by the first housing 11. The second motor 6 is supported on the lower side in the axial direction by the second housing 12. The second housing 12 is fixed to the first housing 11.

Due to the casing 8, the plurality of ribs 9, the motor housing 10, the first housing 11, and the second housing 12 being arranged to have the above-described positional relationship, the blower apparatus 1 can be achieved which uses the casing 8 having a unitary structure and which is provided with the first motor 3 and the second motor 6 arranged in the axial direction in the casing 8. Since the casing 8 has a unitary structure, the ribs 9 integrally formed with the casing 8 can also be configured to be unitary in the axial direction. In this case, the thickness of each of the ribs 9 in the axial direction for ensuring strength can be reduced as compared with the conventional configuration in which two casings are bonded to each other.

Thus, the thickness in the axial direction of the motor housing 10 located radially inward of the ribs 9 can also be reduced as compared with the configuration in which two casings are bonded to each other. As a result, the casing 8 can be reduced in thickness in the axial direction, as compared to a configuration in which two casings are bonded to each other, whereby the blower apparatus 1 can be reduced in thickness. That is, the casing 8 and the blower apparatus 1 can be reduced in thickness with reliability being ensured by ensuring the required strength of the ribs 9.

Conversely, when the thickness of the casing 8 in the axial direction is constant, for example, the strength of each rib 9 can be quadrupled by simply doubling the thickness of each rib 9 in the axial direction, as compared with the case where two parts are bonded to each other in the axial direction to construct the casing. Therefore, in this case, it is possible to achieve the casing 8 that is resistant to impact and not easily broken, and the reliability of the blower apparatus 1 can be further improved.

In addition, in the configuration where two parts are bonded to each other to construct the casing, if distortion occurs in the bonding surface of at least one of the two parts, vibration occurs, and noise is generated when the blower apparatus is driven. However, when the casing 8 has a unitary structure as in the present example embodiment, there is no problem of vibration and noise unique to the above-described configuration where two parts are bonded to each other.

Furthermore, since the second housing 12 is fixed to the first housing 11, the blower apparatus 1 can be assembled as follows. Specifically, the first bearing holding unit 35 is inserted into the first housing 11 from below in the axial direction, for example. Next, the first stator 33 with the first circuit board 4 is inserted into the casing 8 from above in the axial direction until the stator core 331 contacts the cylindrical part 111 of the first housing 11. Then, the first bearing holding unit 35 is press fitted into the radially inner side of the first stator 33, and the first bearing holding unit 35 is fixed to the first stator 33. Note that the first bearing holding unit 35 and the first stator 33 may be fixed using an adhesive agent.

Next, the first bearing 32, the first spring 36, and the first impeller 2 with the first shaft 31 are sequentially inserted into the casing 8 from above in the axial direction. Then, the first C retaining ring 37 is inserted into the casing 8 from below in the axial direction and attached to the first shaft 31. In this way, the attachment of the first impeller 2 and the first motor 3 to the inside of the casing 8 is completed.

On the other hand, the second stator 63, the second bearing holding unit 65, the second bearing 62, the second spring 66, and the second impeller 5 with the second shaft 61 are mounted to the second housing 12, and the second C retaining ring 67 is attached near the upper end of the second shaft 61 in the axial direction.

Next, the second housing 12 is attached to the first housing 11 from below in the axial direction. Thus, the attachment of the second impeller 5 and the second motor 6 to the inside of the casing 8 is completed, and the assembly of the blower apparatus 1 is completed.

As described above, when the blower apparatus 1 is assembled, a method for assembling some of the components of the blower apparatus 1 at the outside of the casing 8, and then, inserting the assembled components to the casing 8 can be used. As a result, the blower apparatus 1 can be easily assembled, and ease of assembly can be improved. That is, even if the casing 8 of the blower apparatus 1 accommodating inside the first impeller 2, the second impeller 5, the first motor 3, and the second motor 6 has a unitary structure, the assembly of the blower apparatus 1 can be facilitated.

Further, as described above, the motor housing 10, and the cylindrical part 111 and the connection part 112 which constitute the first housing 11 are integrally formed. Further, the second housing 12 is a component fixed to the first housing 11, and therefore, the second housing 12 is a separate component from the motor housing 10 and the first housing 11. That is, the motor housing 10 and the first housing 11 are an integral member, and the motor housing 10 and the second housing 12 are separate members.

In this configuration, it is only sufficient to use two members, which are the motor housing 10 integral with the first housing 11 and the second housing 12, for the housings necessary for supporting the first motor 3 and the second motor 6 in the casing 8. Therefore, the cost for the components of the blower apparatus 1 can be reduced. Further, since the motor housing 10 and the first housing 11 are integrated, a structure for supporting the first housing 11 on the motor housing 10 is unnecessary. Therefore, the structure for supporting the first motor 3 and the second motor 6 in the casing 8 is simplified.

As shown in FIG. 6, the first housing 11 has a dent part 132 in the holding part 113 described above. The dent part 132 is formed to be recessed radially outward from the inner surface 113*a* of the holding part 113. The dent part 132 is formed into a shape conforming to the shape of a protrusion 131 of the second housing 12.

The second housing 12 has the protrusion 131. The protrusion 131 is formed to protrude further outward in the radial direction from the radially outer end 121*a* of the flange 121 of the second housing 12.

When the second housing 12 is brought close to the first housing 11 from below in the axial direction, the protrusion 131 of the second housing 12 contacts a corner 113*b* of the holding part 113 of the first housing 11. When the second housing 12 is further pushed upward in the axial direction, a force for pushing the protrusion 131 radially inward is exerted due to a reaction force to the force applied to the corner 113*b* by the protrusion 131. As a result, the second housing 12 is slightly deformed such that the protrusion 131 moves to the inside of the holding part 113.

When the protrusion 131 reaches the dent part 132 due to the second housing 12 being further pushed upward in the axial direction, the force for pushing the protrusion 131 radially inward is released. Thus, the deformation of the second housing 12 is released, and the protrusion 131 fits into the dent part 132. As a result, the second housing 12 is prevented from being dislodged axially downwardly from the first housing 11, and is fixed to the first housing 11.

The structure in which the second housing 12 is fixed to the first housing 11 by the protrusion 131 being fitted into the dent part 132 in this manner is referred to as the snap-fit 13. That is, the second housing 12 is fixed to the first housing 11 by the snap-fit 13. In this case, since the first housing 11 and the second housing 12 can be easily fixed by the snap-fit 13, the assembly of the blower apparatus 1 is further facilitated.

The method for fixing the second housing 12 and the first housing 11 is not limited to the above method using the snap-fit 13. For example, the second housing 12 and the first housing 11 may be fixed by screwing, may be fixed using a rivet, or may be fixed using an adhesive. However, from the viewpoint of further improving the ease of assembly, a fixing method using the snap-fit 13 as in the present example embodiment is desirable.

As shown in FIGS. 5 and 6, the first housing 11 has a first recessed part 100P and a second recessed part 100Q. The first recessed part 100P is formed to be open at the upper side in the axial direction and to be closed at the lower side in the axial direction. Any of the mounted components 41 on the first circuit board 4 is inserted into the first recessed part 100P from above in the axial direction.

Here, from among the mounted components 41, a component protruding to the side opposite to the stator core 331 from the first circuit board 4 (that is, protruding downward in the axial direction) can be considered to be inserted into the first recessed part 100P. In particular, the binding pin which is tall in the axial direction can be considered to be one of the mounted components 41 which is to be inserted into the first recessed part 100P. However, it is obvious that any other components such as a capacitor may be inserted into the first recessed part 100P.

The second recessed part 100Q is formed to be open at the lower side in the axial direction and to be closed at the upper side in the axial direction. Any of the mounted components 71 on the second circuit board 7 is inserted into the second recessed part 100Q from below in the axial direction. Here, from among the mounted components 71, a component protruding to the side opposite to the stator core 631 from the second circuit board 7 (that is, protruding upward in the axial direction) can be considered to be inserted into the second recessed part 100Q. In particular, the binding pin which is tall in the axial direction can be considered to be one of the mounted components 71 which is to be inserted into the second recessed part 100Q. However, it is obvious that any other components such as a capacitor may be inserted into the second recessed part 100Q.

In this configuration, the mounted component 41 mounted on the first circuit board 4 and protruding downward in the axial direction is inserted into the first recessed part 100P in the casing 8. Further, the mounted component 71 mounted on the second circuit board 7 and protruding upward in the axial direction is inserted into the second recessed part 100Q in the casing 8. As a result, even if the distance between the first circuit board 4 and the second circuit board 7 in the axial direction is shortened, electrical insulation can be ensured. Therefore, the casing 8 can be entirely reduced in thickness in the axial direction by bringing the first impeller 2 and the second impeller 5 close to each other in the axial direction, whereby the blower apparatus 1 can be further reduced in thickness.

In the first housing 11, it is desirable that the first recessed part 100P and the second recessed part 100Q are offset from each other in at least one of the circumferential direction and the radial direction. In this configuration, the first recessed part 100P and the second recessed part 100Q do not make a through hole by being connected to each other in the axial direction. Therefore, it is not necessary to provide a wall between the first recessed part 100P and the second recessed part 100Q for separating the opening of the first recessed part 100P and the opening of the second recessed part 100Q in the axial direction. Accordingly, the thickness of the first housing 11 (particularly, the connection part 112) in the axial direction can be reduced because it is not necessary to provide the wall. As a result, the axial distance between the first circuit board 4 and the second circuit board 7 can be shortened, whereby the axial distance between the first impeller 2 and the second impeller 5 can be shortened. Consequently, it is possible to further reduce the thickness of the casing 8 and the blower apparatus 1.

Another exemplary example embodiment of the present disclosure will be described in detail with reference to the accompanying drawings. In a blower apparatus 1 according to the present example embodiment, the configuration other than the motor housing 10, the first housing 11, and the second housing 12 is the same as that of the first example embodiment, and thus the description thereof will be omitted below.

Figure 7:
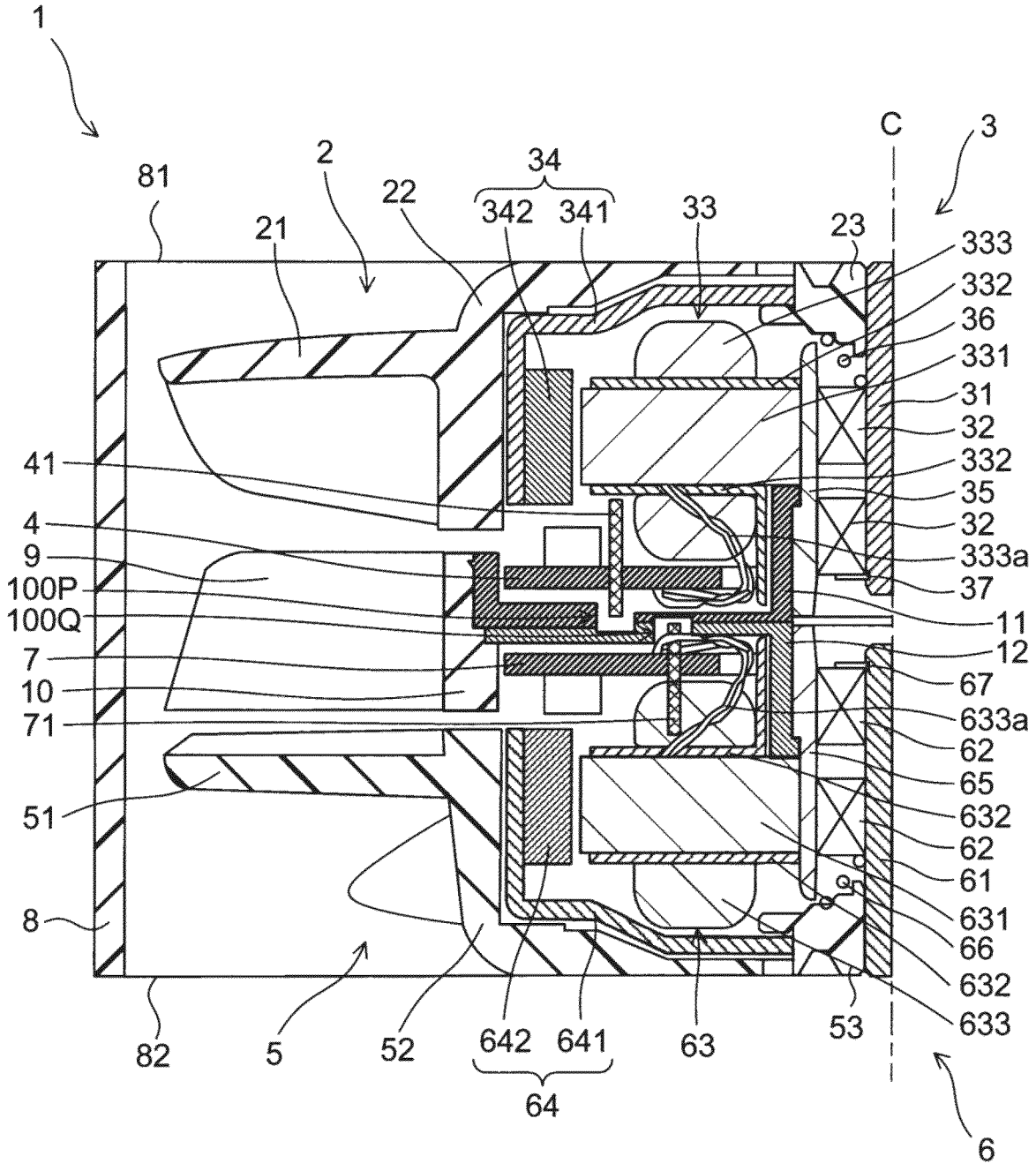
FIG. 7 is a longitudinal sectional view showing a configuration of a blower apparatus according to another example embodiment of the present disclosure.
Figure 8:
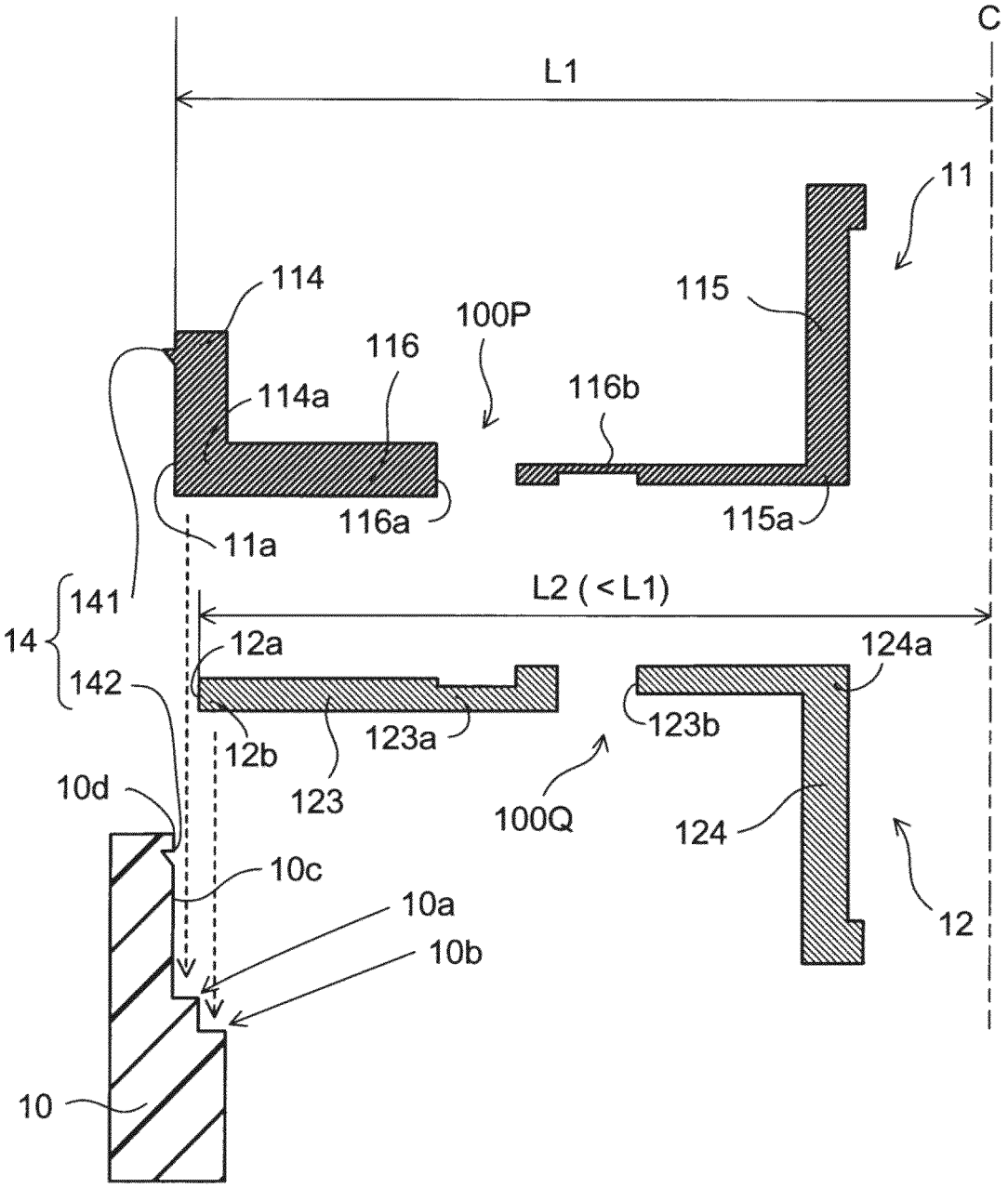
FIG. 8 is an exploded sectional view of a motor housing, a first housing, and a second housing of the blower apparatus.

FIG. 7 is a longitudinal sectional view showing the blower apparatus 1 according to the present example embodiment. For convenience, FIG. 7 shows the cross section of only one side of the blower apparatus 1 in the radial direction with respect to the central axis C. FIG. 8 is an exploded sectional view of the motor housing 10, the first housing 11, and the second housing 12 of the blower apparatus 1 shown in FIG. 7. In the present example embodiment, the motor housing 10, the first housing 11, and the second housing 12 are different members.

The first housing 11 and the second housing 12 are arranged in the axial direction. In particular, the first housing 11 is located above the second housing 12 in the axial direction. When a distance from the central axis C to an outer surface 11*a* which is a radially outer surface of the first housing 11 is defined as L1 (mm), and a distance from the central axis C to an outer surface 12*a* which is a radially outer surface of the second housing 12 is defined as L2 (mm), L2<L1 is established. That is, the outer surface 11*a* of the first housing 11 is located radially outward of the outer surface 12*a* of the second housing 12.

The first housing 11 has a large diameter part 114, a cylindrical part 115, and a connection part 116. The large diameter part 114 is the outermost part of the first housing 11 in the radial direction, and is formed to surround the connection part 116. The connection part 116 is formed to surround the cylindrical part 115. The cylindrical part 115 is formed to surround the central axis C.

The connection part 116 connects the large diameter part 114 and the cylindrical part 115 in the radial direction. More specifically, the connection part 116 radially connects a lower end 114*a* of the large diameter part 114 in the axial direction and a lower end 115*a* of the cylindrical part 115 in the axial direction. Thus, the first housing 11 in which the large diameter part 114, the cylindrical part 115, and the connection part 116 are integrated is configured.

The second housing 12 has a plate-shaped part 123 and a cylindrical part 124. The plate-shaped part 123 is a plate member extending radially outward from an upper end 124*a* of the cylindrical part 124 in the axial direction. The cylindrical part 124 is formed to surround the central axis C.

The first housing 11 is fixed to the first bearing holding unit 35 of the first motor 3, thereby supporting the first motor 3. The second housing 12 is fixed to the second bearing holding unit 65 of the second motor 6, thereby supporting the second motor 6.

The blower apparatus 1 according to the present example embodiment also has a first recessed part 100P and a second recessed part 100Q in the first housing 11 and the second housing 12. The first recessed part 100P is formed to be open at the upper side in the axial direction and to be closed at the lower side in the axial direction. The second recessed part 100Q is formed to be open at the lower side in the axial direction and to be closed at the upper side in the axial direction.

The first recessed part 100P has a through hole 116*a* and a lid part 123*a*. The through hole 116*a* is a hole which passes through the connection part 116 of the first housing 11 in the axial direction. The lid part 123*a* is located at the second housing 12 and closes the through hole 116*a*. The lid part 123*a* is constituted by a portion of the plate-shaped part 123 of the second housing 12.

The second recessed part 100Q has a through hole 123*b* and a lid part 116*b*. The through hole 123*b* is a hole that passes through the plate-shaped part 123 of the second housing 12 in the axial direction. The lid part 116*b* is located at the first housing and closes the through hole 123*b*. The lid part 116*b* is constituted by a portion of the connection part 116 of the first housing 11.

A mounted component 41 mounted on the first circuit board 4 and protruding downward in the axial direction is inserted into the first recessed part 100P from above in the axial direction. Further, a mounted component 71 mounted on the second circuit board 7 and protruding upward in the axial direction is inserted into the second recessed part 100Q from below in the axial direction in the casing 8. This can provide the effect of reducing the blower apparatus 1 in thickness by shortening the axial distance between the first circuit board 4 and the second circuit board 7, as in the first example embodiment.

The first housing 11 and the second housing 12 having the above-described configurations are fixed to the motor housing 10, and therefore, the motor housing 10 is slightly different from that shown in FIGS. 5 and 6.

The motor housing 10 has a first receiving portion 10*a* and a second receiving portion 10*b*. The first receiving portion 10*a* is located radially inward of the plurality of ribs 9. The first receiving portion 10*a* receives the first housing 11, which is inserted from above in the axial direction, at a position axially above and radially outward of the second receiving portion 10*b*. The second receiving portion 10*b* receives the second housing 12 which is inserted from above in the axial direction.

That is, the motor housing 10 has the first receiving portion 10*a* located radially inward of the plurality of ribs 9 and receiving the first housing 11 in the axial direction, and the second receiving portion 10*b* located radially inward of the first receiving portion 10*a* and receiving the second housing 12 in the axial direction. In the present example embodiment, the blower apparatus 1 can be assembled as follows.

First, the second stator 63 with the second circuit board 7, the second bearing holding unit 65, and the second bearing 62 are attached to the second housing 12 outside the casing 8. Then, the second housing 12 is inserted into the casing 8 from above in the axial direction. Thereafter, the second spring 66 and the second impeller 5 with the second shaft 61 are sequentially inserted from below in the axial direction, and the second C retaining ring 67 is attached in the vicinity of the axially upper end of the second shaft 61.

Next, the first stator 33 with the first circuit board 4, the first bearing holding unit 35, the first bearing 32, the first spring 36, the first impeller 2 with the first shaft 31, and the first C retaining ring 37 are sequentially attached to the first housing 11 outside the casing 8. Thereafter, the first housing 11 is inserted into the casing 8 from above in the axial direction and fixed. Thus, the blower apparatus 1 is completed.

As described above, in the present example embodiment, the motor housing 10, the first housing 11, and the second housing 12 are separate members. Therefore, outside the casing 8, a part of the second motor 6 can be attached to the second housing 12, and the first motor 3 can be attached to the first housing 11, as described above. Finally, the first housing 11 and the second housing 12 can be attached to the motor housing 10 of the casing 8 to complete the blower apparatus 1. As described above, since a part of the blower apparatus 1 can be assembled outside the casing 8, the workability at the time of assembly is improved.

In particular, the motor housing 10 has the first receiving portion 10*a* and the second receiving portion 10*b* described above. Therefore, the blower apparatus 1 can be assembled by inserting the second housing 12 into the casing 8 from above in the axial direction, and then inserting the first housing 11 similarly from above in the axial direction. As described above, since the insertion directions of the first housing 11 and the second housing 12 into the casing 8 are the same, the assembly of the blower apparatus 1 can be facilitated.

Further, when the second housing 12 is inserted into the casing 8 from above in the axial direction during the assembly of the blower apparatus 1 described above, the second housing 12 comes in contact with the second receiving portion 10*b* of the motor housing 10 at its radially outer end 12*b*, and stops. When the first housing 11 is then inserted into the casing 8 similarly from above in the axial direction, the first housing 11 comes in contact with the first receiving portion 10*a* of the motor housing 10 at its radially outer end 114*a*, and stops. In this state, the second housing 12 is axially held between the second receiving portion 10*b* and the first housing 11, and is fixed to the motor housing 10.

That is, the second housing 12 is fixed to the motor housing 10 by being axially held between the second receiving portion 10*b* of the motor housing 10 and the first housing 11 received by the first receiving portion 10*a*. Since the second housing 12 is fixed in this manner, a separate fixing member (for example, an adhesive) for fixing the second housing 12 to the motor housing 10 can be eliminated, whereby the second housing 12 can be fixed to the motor housing 10 by a simple configuration.

As shown in FIG. 8, the first housing 11 has a protrusion 141. The protrusion 141 is formed to protrude radially outward from the outer surface 11*a* of the first housing 11. The motor housing 10 also has a dent part 142. The dent part 142 is formed to be recessed radially outward from the inner surface 10*c* of the motor housing 10. The inner surface 10*c* of the motor housing 10 is located above the first receiving portion 10*a* in the axial direction. The inner surface 10*c* contacts the outer surface 11*a* of the first housing 11, by which the first housing 11 slides in the axial direction. The dent part 142 is formed into a shape conforming to the shape of the protrusion 141 of the first housing 11.

When the first housing 11 is moved downward in the axial direction, the protrusion 141 of the first housing 11 comes in contact with the corner 10*d* of the motor housing 10. When the first housing 11 is further pushed downward in the axial direction, a force for pushing the protrusion 141 radially inward is exerted due to a reaction force to the force applied to the corner 10*d* by the protrusion 141. As a result, the first housing 11 is slightly deformed such that the protrusion 141 moves toward the radially inner side of the motor housing 10.

When the protrusion 141 reaches the dent part 142 due to the first housing 11 being further pushed downward in the axial direction, the force for pushing the protrusion 141 radially inward with respect to the dent part 142 is released. Thus, the deformation of the first housing 11 is released, and the protrusion 141 fits into the dent part 142. As a result, the first housing is prevented from being dislodged upwardly from the motor housing 10 in the axial direction, and is fixed to the motor housing 10.

The structure in which the first housing 11 is fixed to the motor housing 10 by the protrusion 141 being fitted into the dent part 142 in this manner is referred to as a snap-fit 14. That is, the first housing 11 is fixed to the motor housing 10 by the snap-fit 14. Since the first housing 11 and the motor housing 10 can be easily fixed by the snap-fit 14, the assembly of the blower apparatus 1 is further facilitated.

The method for fixing the first housing 11 and the motor housing 10 is not limited to the above method using the snap-fit 14. That is, the first housing 11 and the motor housing 10 may be fixed by screwing, may be fixed using a rivet, or may be fixed using an adhesive. However, from the viewpoint of further improving the ease of assembly, a fixing method using the snap-fit 14 is desirable.

Figure 9:
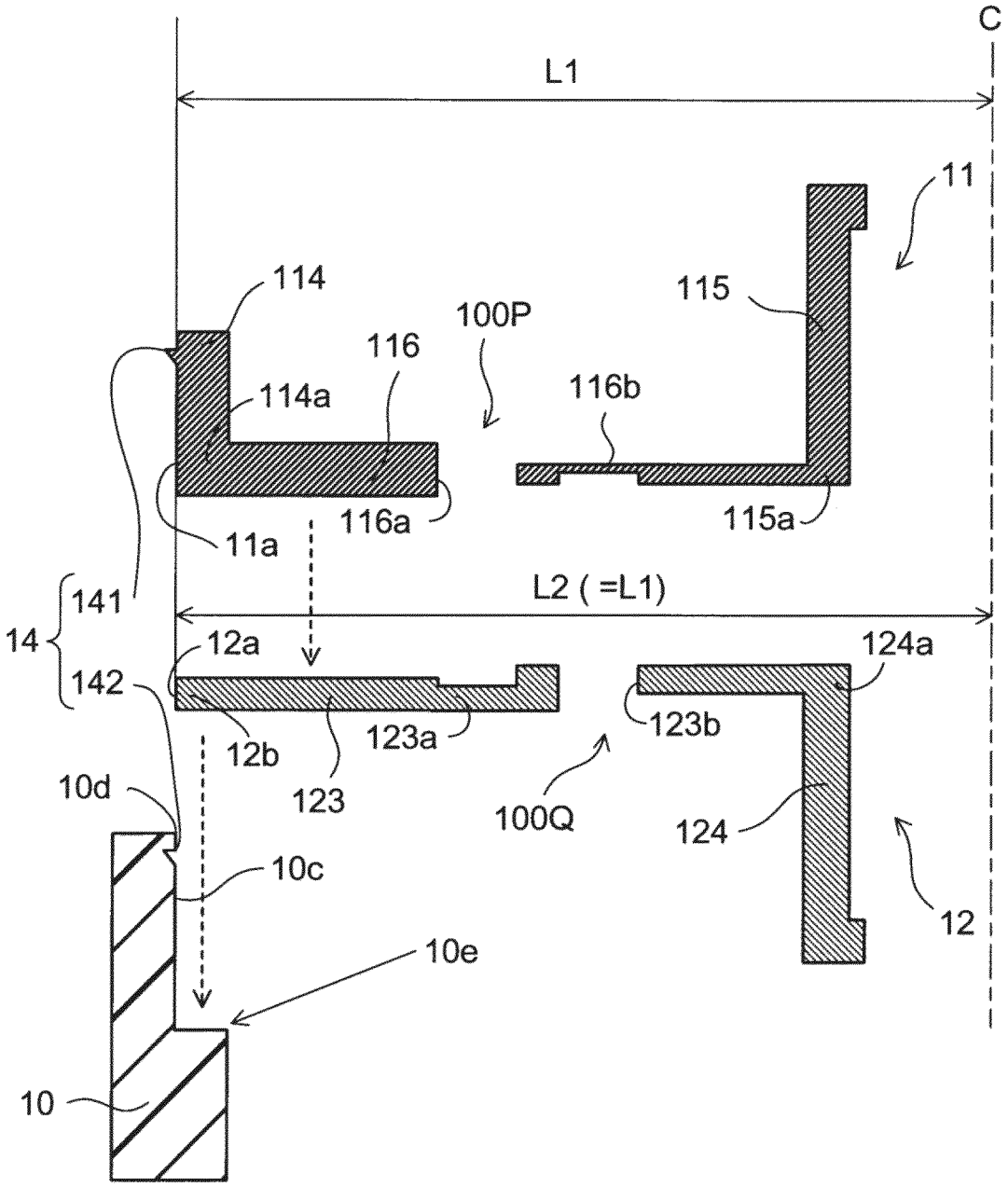
FIG. 9 is an exploded sectional view showing another configuration of the motor housing, the first housing, and the second housing of the blower apparatus.

FIG. 9 is an exploded sectional view showing another configuration of the motor housing 10 and the second housing 12. In the configuration shown in FIG. 9, when the distance from the central axis C to the outer surface 11*a* of the first housing 11 is defined as L1 (mm), and the distance, that is, the radial length, from the central axis C to the outer surface 12*a* of the second housing 12 is defined as L2 (mm), L2=L1 is established. That is, the outer surface 11*a* of the first housing 11 is located at the same position as the outer surface 12*a* of the second housing 12 in the radial direction.

Further, the motor housing 10 has a housing receiving portion 10*e*. The housing receiving portion 10*e* is located radially inward of the plurality of ribs 9. The housing receiving portion 10*e* simultaneously receives the first housing 11 and the second housing 12 which are inserted from above in the axial direction. That is, the motor housing 10 has the housing receiving portion 10*e* located radially inward of the plurality of ribs 9 and receiving the second housing 12 together with the first housing 11 in the axial direction.

When the radial lengths of the first housing 11 and the second housing 12 are the same, both the first housing 11 and the second housing 12 of the motor housing 10 can be received by the single housing receiving portion 10*e* in the axial direction. Therefore, it is not necessary to provide different receiving portions for individually receiving the first housing 11 and the second housing 12 to the motor housing 10, as shown in FIG. 8. In other words, it is only sufficient that only one receiving portion which is the minimum necessary is provided. Therefore, the configuration of the motor housing 10 can be simplified as compared with the configuration in FIG. 8.

Further, when the second housing 12 is inserted into the casing 8 from above in the axial direction in the configuration shown in FIG. 9, the second housing 12 comes in contact with the housing receiving portion 10*e* of the motor housing 10 at the radially outer end 12*b*, and stops. When the first housing 11 is then inserted into the casing 8 similarly from above in the axial direction, the first housing 11 comes in contact with the second housing 12 and stops. In this state, the second housing 12 is axially held between the housing receiving portion 10*e* and the first housing 11, and is fixed to the motor housing 10.

That is, the second housing 12 is fixed to the motor housing 10 by being axially held between the housing receiving portion 10*e* of the motor housing 10 and the first housing 11. Since the second housing 12 is fixed in this manner, a separate fixing member (for example, an adhesive) for fixing the second housing 12 to the motor housing 10 can be eliminated, whereby the second housing 12 can be fixed to the motor housing 10 by a simple configuration.

In the configuration shown FIG. 9, the first housing 11 may also be fixed to the motor housing 10 by the snap-fit 14 as in the configuration shown in FIG. 8.

Figure 10:
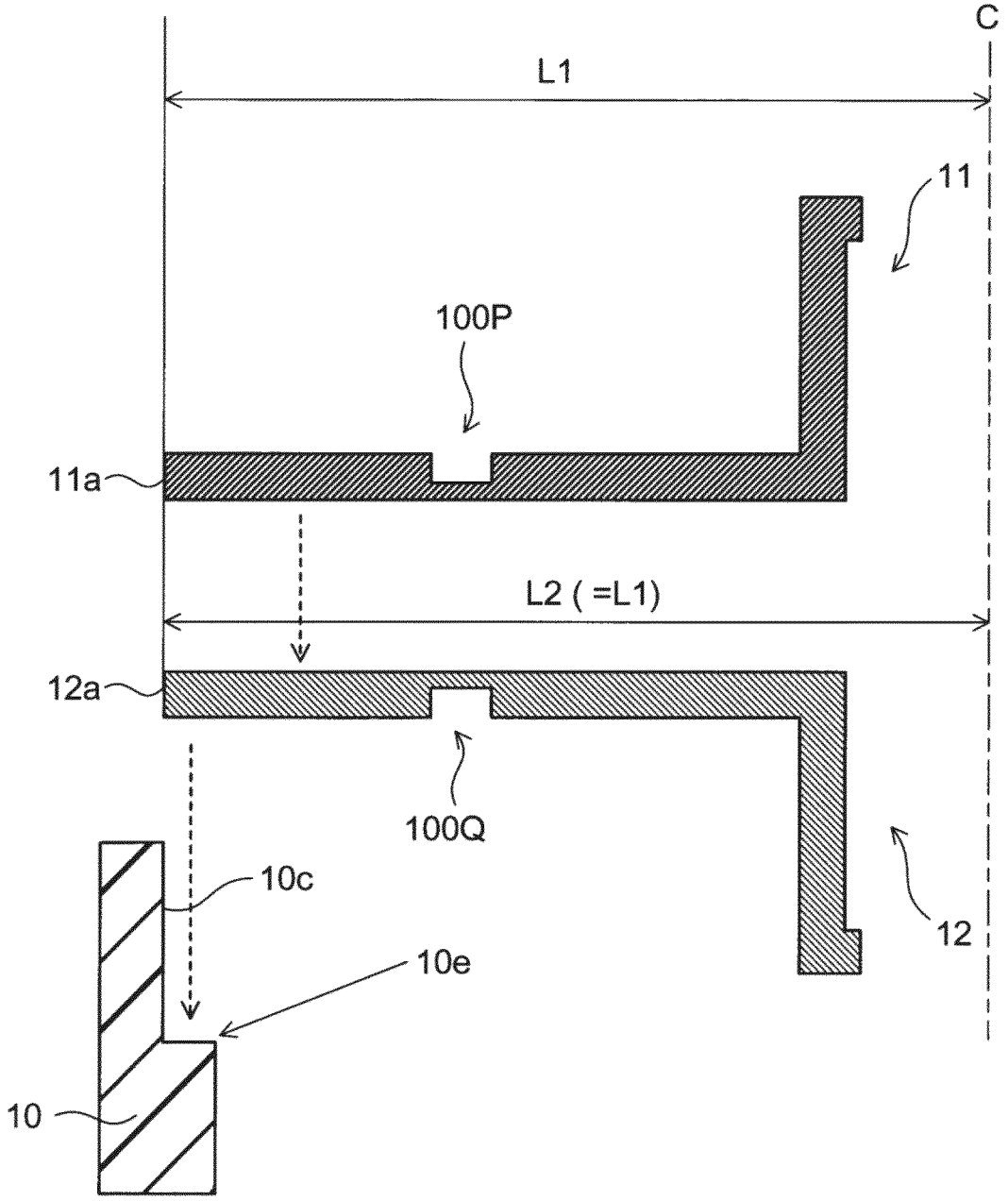
FIG. 10 is an exploded sectional view showing still another configuration of the motor housing, the first housing, and the second housing of the blower apparatus.

FIG. 10 is an exploded sectional view showing still another configuration of the motor housing 10, the first housing 11, and the second housing 12. When the housing receiving portion 10*e* of the motor housing 10 receives, in the axial direction, the first housing 11 and the second housing 12 which have the same radial length, a member having the same shape as the second housing 12 can be used for the first housing 11. That is, when the second housing 12 is vertically inverted and arranged, the inverted second housing 12 can be used as the first housing 11. Therefore, it is only sufficient that only one type of member is used for the first housing 11 and the second housing 12, whereby cost for the components can be reduced.

When the member having the same shape as the second housing 12 is used for the first housing 11, the motor housing 10, the first housing 11, and the second housing 12 may be fixed to one another by screwing, by using an adhesive, or by snap-fit. Moreover, when the first housing 11 and the second housing 12 which have the same shape are used, it is desirable to fix them by rotating one of the first housing 11 and the second housing 12 with respect to the other in the circumferential direction. In this case, the thickness of the blower apparatus 1 can be reduced by providing the first recessed part 100*p* and the second recessed part 100Q so as not to overlap each other in the axial direction.

Figure 11:
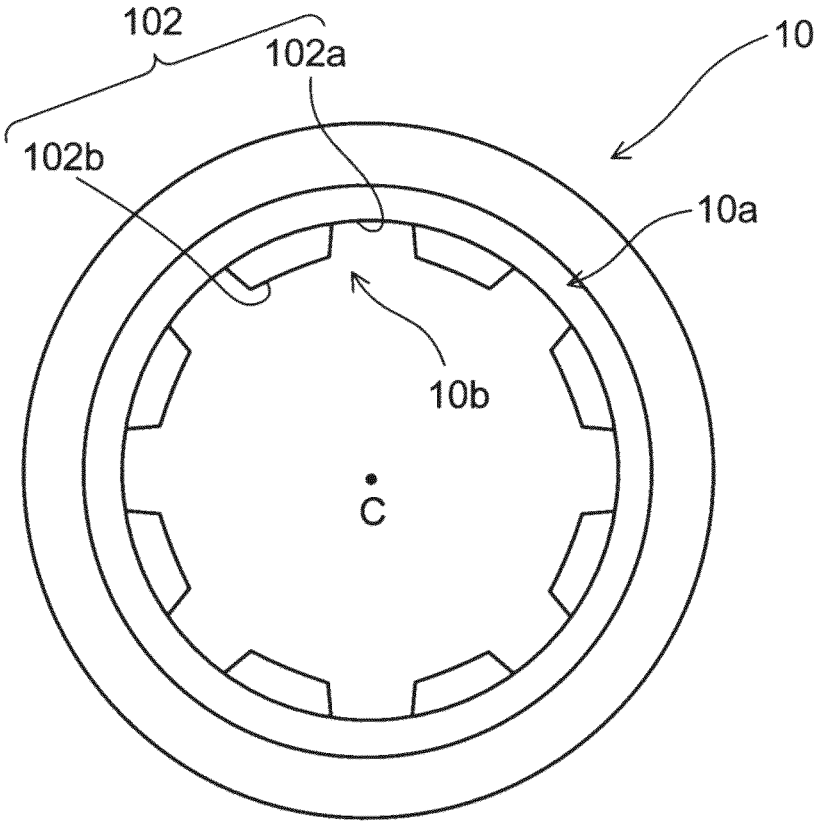
FIG. 11 is a plan view of a second receiving portion of the motor housing as viewed from above in the axial direction.

FIG. 11 is a plan view of the second receiving portion 10*b* of the motor housing 10 as viewed from above in the axial direction. The second receiving portion 10*b* has an inner surface 102. The inner surface 102 is on the radially inner side of the second receiving portion 10*b* so as to surround the central axis C. The inner surface 102 is a spline-shaped uneven surface, and is formed by alternately providing first grooves 102*a* and first protruding portions 102*b* in the circumferential direction.

The first grooves 102*a* extend along the axial direction. That is, the first grooves 102*a* are recessed outward in the radial direction. The first protruding portions 102*b* protrude inward in the radial direction. That is, the second receiving portion 10*b* has the inner surface 102 having first grooves 102*a* recessed outward in the radial direction and first protruding portions 102*b* protruding inward in the radial direction, the first grooves 102*a* and the first protruding portions 102*b* being alternately arranged in the circumferential direction.

Figure 12:
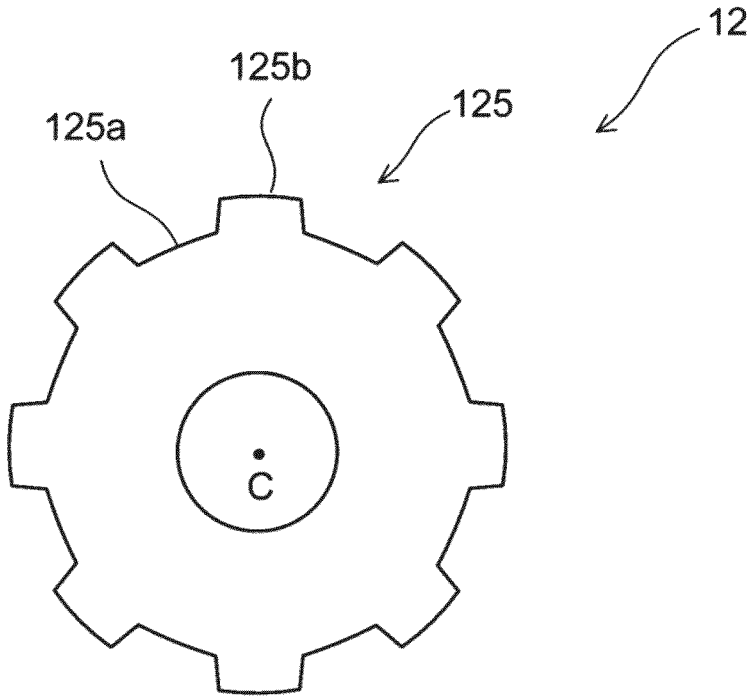
FIG. 12 is a plan view of the second housing as viewed from above in the axial direction.

FIG. 12 is a plan view of the second housing 12 as viewed from above in the axial direction. The second housing 12 has an outer surface 125. The outer surface 125 is on the radially outer side of the second housing 12 so as to surround the central axis C. The outer surface 125 is a spline-shaped uneven surface, and is formed by alternately providing second grooves 125*a* and second protruding portions 125*b* in the circumferential direction. The outer surface 125 is formed into a shape conforming to the shape of the inner surface 102 of the second receiving portion 10*b*.

The second grooves 125*a* extend along the axial direction. That is, the second grooves 125*a* are recessed inward in the radial direction. The second protruding portions 125*b* protrude outward in the radial direction. That is, the second housing 12 has the outer surface 125 having second grooves 125*a* recessed inward in the radial direction and second protruding portions 125*b* protruding outward in the radial direction, the second grooves 125*a* and the second protruding portions 125*b* being alternately arranged in the circumferential direction. The outer surface 125 of the second housing 12 has a shape conforming to the shape of the inner surface 102 of the second receiving portion 10*b*.

In the above configuration, the blower apparatus 1 can be assembled as follows. Specifically, the second stator 63 with the second circuit board 7, the second bearing holding unit 65, the second bearing 62, the second spring 66, and the second impeller 5 with the second shaft 61 are attached to the second housing 12 outside the casing 8, and the second C retaining ring 67 is attached to the second shaft 61. In this state, the second housing 12 is inserted into the second receiving portion 10*b* from below in the axial direction, and after the second housing 12 passes through the second receiving portion 10*b* toward the upper side in the axial direction, the second housing 12 is rotated in the circumferential direction.

Figure 13:
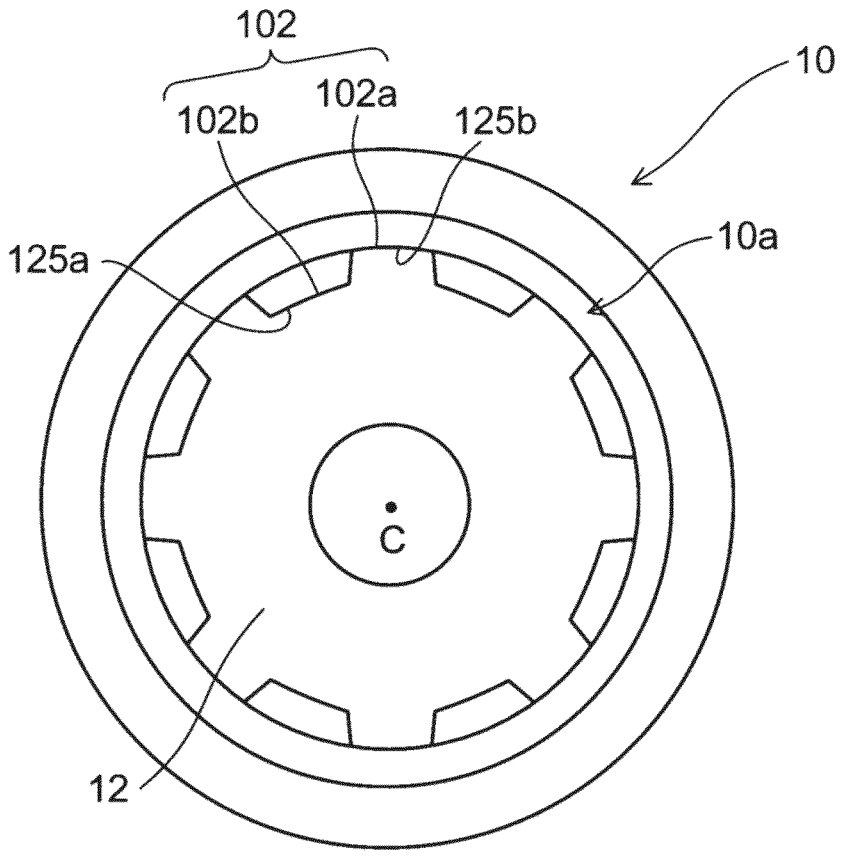
FIG. 13 is a plan view of a state in which the second housing is inserted into the second receiving portion as viewed from above in the axial direction.

FIG. 13 is a plan view of the state in which the second housing 12 is inserted into the second receiving portion 10*b* as viewed from above in the axial direction. The second housing 12 and the second receiving portion 10*b* are positioned such that the first protruding portions 102*b* of the second receiving portion 10*b* are engaged with the second grooves 125*a* of the second housing 12, and the second protruding portions 125*b* of the second housing 12 are engaged with the first grooves 102*a* of the second receiving portion 10*b*, whereby the second housing 12 can be inserted into the second receiving portion 10*b* in the axial direction.

Figure 14:
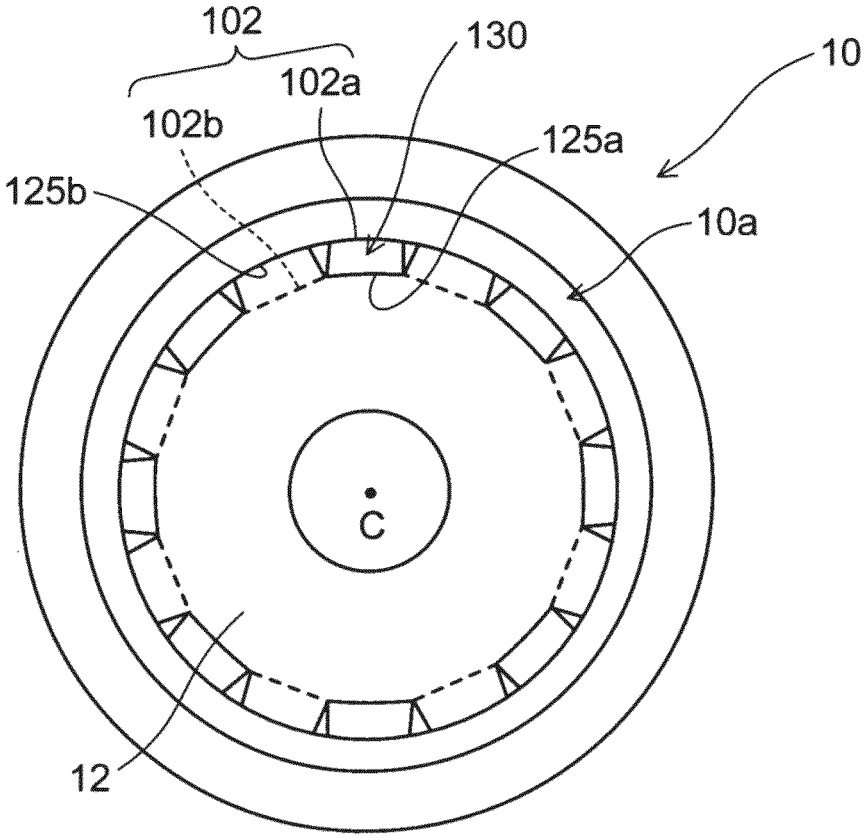
FIG. 14 is a plan view of a state in which the second housing is rotated with respect to the second receiving portion as viewed from above in the axial direction.

FIG. 14 is a plan view showing a state in which the second housing 12 is rotated with respect to the second receiving portion 10*b* as viewed from above in the axial direction. When the second housing 12 is rotated, the second protruding portions 125*b* of the second housing 12 overlap with the first protruding portions 102*b* of the second receiving portion 10*b* as viewed in the axial direction. In this state, the second protruding portions 125*b* are caught by the first protruding portions 102*b*, which prevents the second housing 12 from being dislodged downwardly in the axial direction. That is, the second housing 12 is fixed to the second receiving portion 10*b*. Then, the first impeller 2 and the first motor 3 are placed in the casing 8 in the same manner as in FIG. 8.

As described above, since the inner surface 102 of the second receiving portion 10*b* and the outer surface 125 of the second housing 12 have a spline shape, the method for inserting the second housing 12 to the motor housing 10, which is integral with the casing 8, from below in the axial direction can be employed. Therefore, both the first motor 3 and the second motor 6 can be attached to the first housing 11 and the second housing 12, respectively, outside the casing 8, and then, can be placed in the casing 8. Thus, the ease of assembly can be further improved.

Figure 15:
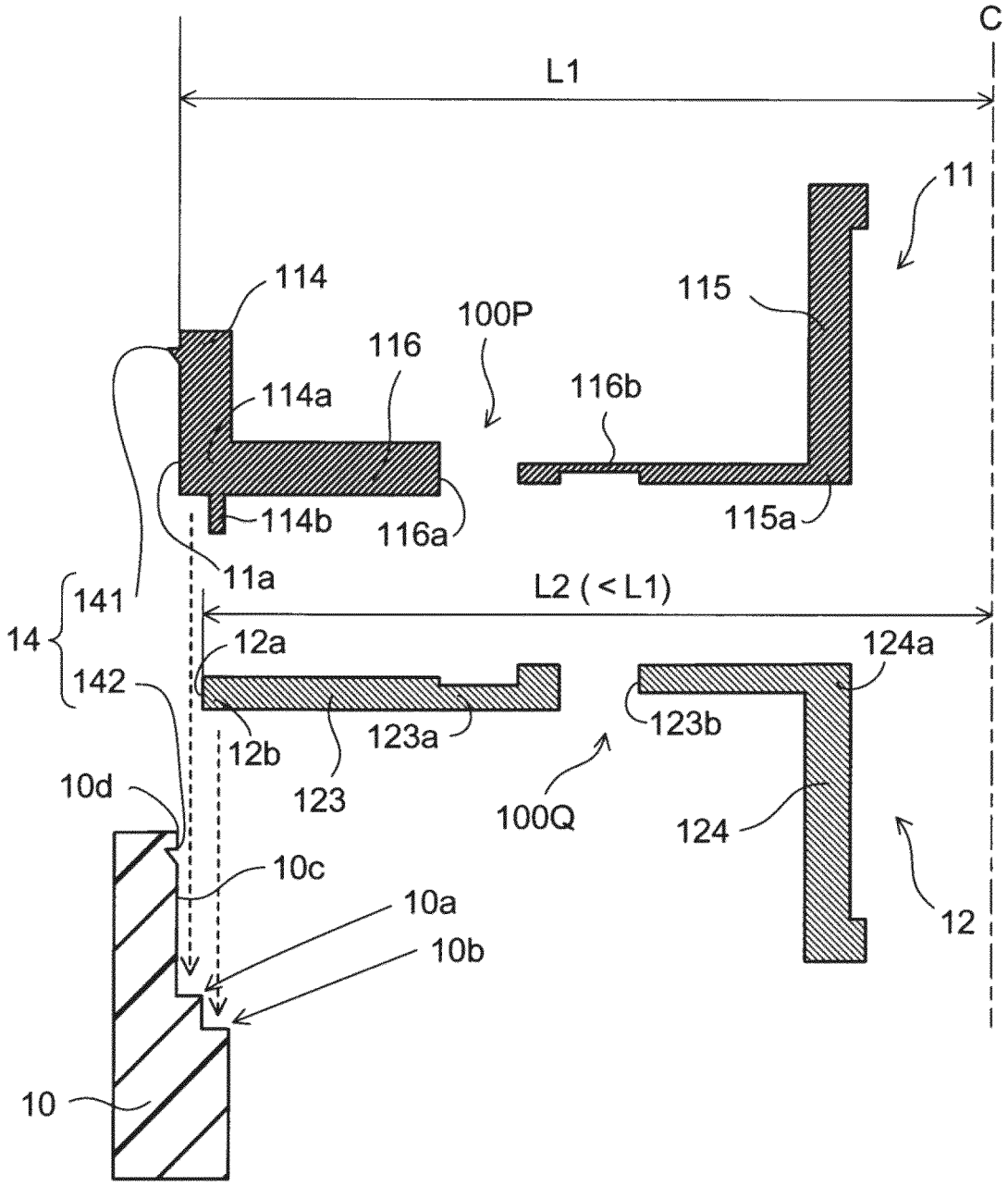
FIG. 15 is a sectional view showing still another configuration of the motor housing, the first housing, and the second housing of the blower apparatus.

FIG. 15 is a sectional view showing still another configuration of the first housing 11. When the inner surface 102 of the second receiving portion 10*b* and the outer surface 125 of the second housing 12 have a spline shape, the first housing 11 may have a projection 114*b*. The projection 114*b* has a shape that fits into a hole portion 130 shown in FIG. 14 when the first housing 11 is inserted downward into the motor housing 10 in the axial direction. The hole portion 130 is a hole formed from the first groove 102*a* and the second groove 125*a* overlapping with each other in the axial direction when the second housing 12 is inserted into the second receiving portion 10*b* from below in the axial direction and rotated in the circumferential direction. That is, the first housing 11 has the projection 114*b* fitted in the hole portion 130 formed from the first groove 102*a* of the second receiving portion 10*b* and the second groove 125*a* of the second housing 12 overlapping with each other in the axial direction.

The engagement between the projection 114*b* of the first housing 11 and the hole portion 130 can prevent the second housing from rotating in the circumferential direction and being disengaged from the second receiving portion 10*b*. In addition, when the projection 114*b* of the first housing 11 is engaged with the hole portion 130, a snap-fit can be formed. That is, the projection 114*b* can be used as a part constituting a snap-fit.

Figure 16:
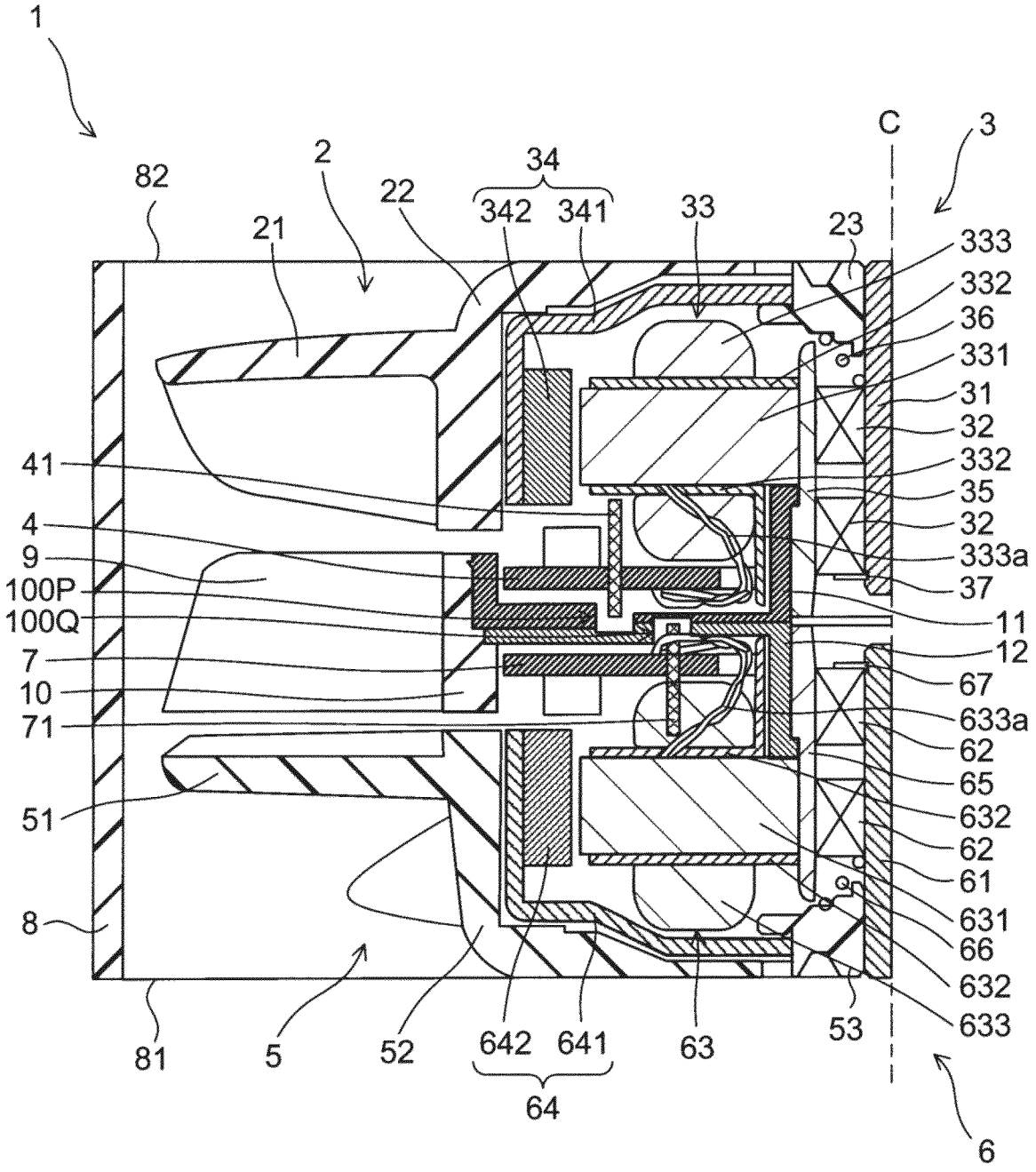
FIG. 16 is a longitudinal sectional view showing another configuration of the blower apparatus.

FIG. 16 is a longitudinal sectional view showing another configuration of the blower apparatus 1 according to the present example embodiment. For convenience, FIG. 16 shows the cross section of only one side of the blower apparatus 1 in the radial direction with respect to the central axis C. In the case where the motor housing 10 and the first housing 11 are fixed by the snap-fit 14 shown in FIG. 8, it is desirable that the air blowing direction is opposite to the air blowing direction in the configuration shown in FIGS. 7 and 8.

That is, in the configuration shown in FIG. 7, the intake port 81 is located on the upper side of the casing 8 in the axial direction, and the discharge port 82 is located on the lower side of the casing 8 in the axial direction, so that air is blown from top to bottom in the axial direction. In contrast, when the fixing method using the snap-fit 14 is employed, it is desirable that the intake port 82 is located on the lower side of the casing 8 in the axial direction, the discharge port 82 is located on the upper side of the casing 8 in the axial direction, and the first motor 3 and the second motor 6 are driven to blow air from bottom to top in the axial direction, as shown in FIG. 16. That is, it is desirable to rotate the first impeller 2 and the second impeller 5 in the direction opposite to the direction in the configuration shown in FIG. 7.

Specifically, in the blower apparatus 1 in FIG. 16, the intake port 81 of the casing 8 is located on the side opposite to the first housing 11 with respect to the second housing 12, and the discharge port 82 of the casing 8 is located on the side opposite to the second housing 12 with respect to the first housing 11, in relation to the axial direction. Further, the first motor 3 and the second motor 6 rotate the first impeller 2 and the second impeller 5, respectively, so that air flows from the intake port 81 toward the discharge port 82.

Generally, in a blower apparatus in which two impellers are arranged coaxially, the impellers receive a force (reaction force) in the direction opposite to the stream of air flowing from the intake port to the discharge port in the casing. When the intake port 81, the discharge port 82, the first housing 11, and the second housing 12 have the positional relationship shown in FIG. 16, the first impeller 2 on the first housing 11 side receives a force (reaction force) toward the intake port 81 side with respect to the stream of air flowing from the intake port 81 toward the discharge port 82. Due to this reaction force, a force of the first housing 11 pressing the second housing 12 to the intake port 81 side is generated. This force is in a direction in which the first housing 11 is engaged with the motor housing 10, and is in a direction opposite to the direction in which the snap-fit 14 is released in the axial direction (a direction in which the first housing 11 is removed from the motor housing 10 in the axial direction). As a result, the snap-fit 14 is less likely to be disengaged. As a result, the fixing of the first housing 11 to the motor housing 10 can be maintained.

While example embodiments of the present disclosure have been described above, it will be understood that the scope of the present disclosure is not limited to the above-described example embodiments, and that various modifications are possible without departing from the spirit of the present disclosure. In addition, features of the above-described example embodiments and the modifications thereof may be combined appropriately as desired.

The blower apparatus according to the present disclosure is applicable to serial axial blowing apparatuses.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A blower apparatus comprising:

a casing including an intake port located on an upper side of a central axis that extends vertically in an axial direction, and a discharge port located on a lower side of the central axis;

a plurality of ribs located radially inward of the casing and integrally provided with the casing;

a motor housing located radially inward of the plurality of ribs and integrally provided with the plurality of ribs;

a first housing located radially inward of the motor housing;

a first bearing support attached to the first housing on an inside of the first housing in a radial direction;

a portion of a first motor supported by the first bearing support on an inside of the first bearing support in the radial direction;

a first impeller rotatable around the central axis by the first motor on a first side of the first motor in the axial direction;

a second housing located on a second side of the first housing in the axial direction;

a second bearing support attached to the second housing on an inside of the second housing in the radial direction;

a portion of a second motor supported by the second bearing support on an inside of the second bearing support in the radial direction; and a second impeller rotatable around the central axis by the second motor on a second side of the second motor in the axial direction; wherein the motor housing, the first housing, and the second housing are each defined by separate members;

a first housing surface is provided on the second side of the first housing in the axial direction; and a second housing surface is provided on a second side of the second housing in the axial direction;

the motor housing includes:

a receiving portion located radially inward of the plurality of ribs; and a receiving surface included in the receiving portion on a first side of the motor housing in the axial direction;

the first housing surface and the second housing surface are located on the receiving surface in the axial direction;

the receiving surface directly opposes the first housing surface and the second housing surface in the axial direction; and the second housing is fixed to the first housing.

2. The blower apparatus according to claim 1, wherein an outer surface of the first housing is located radially outward of an outer surface of the second housing; and the receiving portion includes:

a first receiving portion located radially inward of the plurality of ribs to receive the first housing in the axial direction, and a second receiving portion located radially inward of the first receiving portion to receive the second housing in the axial direction;

the first receiving portion contacts the first housing surface; and the second receiving portion contacts the second housing surface.

3. The blower apparatus according to claim 2, wherein the second housing is fixed to the motor housing by being held between the second receiving portion of the motor housing and the first housing surface contacted by the first receiving portion in the axial direction.

4. The blower apparatus according to claim 2, wherein the second receiving portion includes an inner surface which includes a first groove recessed radially outward and a first protruding portion protruding radially inward, the first groove and the first protruding portion being alternately arranged in a circumferential direction;

the outer surface of the second housing includes a second groove recessed radially inward and a second protruding portion protruding radially outward, the second groove and the second protruding portion being alternately arranged in the circumferential direction; and the outer surface of the second housing has a shape conforming to a shape of the inner surface of the second receiving portion.

5. The blower apparatus according to claim 4, wherein the first housing includes a projection that is engaged with a hole portion provided from the first groove of the second receiving portion and the second groove of the second housing overlapping with each other in the axial direction.

6. The blower apparatus according to claim 1, wherein the first housing is fixed to the motor housing by a snap-fit.

7. The blower apparatus according to claim 6, wherein in relation to the axial direction:

the first housing is between the intake port of the casing and the second housing, and the second housing is between the discharge port of the casing and the first housing; and the first motor and the second motor rotate the first impeller and the second impeller, respectively, such that air flows from the intake port toward the discharge port.

* * * * *